US008768221B2

(12) United States Patent
Saito

(10) Patent No.: US 8,768,221 B2
(45) Date of Patent: Jul. 1, 2014

(54) POWDER DELIVERY MEMBER, AND POWDER STORAGE CONTAINER AND IMAGE FORMING APPARATUS RESPECTIVELY USING SUCH POWDER DELIVERY MEMBER

(75) Inventor: Kazuhiro Saito, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 643 days.

(21) Appl. No.: 12/916,878

(22) Filed: Nov. 1, 2010

(65) Prior Publication Data

US 2011/0262189 A1 Oct. 27, 2011

(30) Foreign Application Priority Data

Apr. 26, 2010 (JP) ..... 2010-100796

(51) Int. Cl.
*G03G 15/08* (2006.01)
*G03G 21/00* (2006.01)

(52) U.S. Cl.
USPC ..... 399/256; 399/98; 399/120; 399/263

(58) Field of Classification Search
USPC ..... 399/98, 102, 103, 105, 106, 120, 256, 399/263
See application file for complete search history.

(56) References Cited

U.S. PATENT DOCUMENTS

| | | | | |
|---|---|---|---|---|
| 5,842,090 | A * | 11/1998 | Mikawa | 399/256 |
| 5,923,931 | A | 7/1999 | Kishimoto | |
| 7,088,943 | B2 | 8/2006 | Iikura et al. | |
| 2008/0170889 | A1 * | 7/2008 | Eto et al. | 399/263 |

FOREIGN PATENT DOCUMENTS

| | | | |
|---|---|---|---|
| CN | 1182899 | A | 5/1998 |
| CN | 101226363 | A | 7/2008 |
| JP | 10142936 | A | 5/1998 |
| JP | 2002296882 | A | 10/2002 |
| JP | 2003-280343 | A | 10/2003 |
| JP | 2004-286772 | A | 10/2004 |
| JP | 2004-354451 | A | 12/2004 |
| JP | 2006-285024 | A | 10/2006 |
| JP | 2008-170896 | A | 7/2008 |

OTHER PUBLICATIONS

Communication dated Jan. 31, 2012 from the Japanese Patent Office in counterpart Japanese application No. 2010-100796.
Office Action dated Jun. 22, 2011 from the Australian Patent Office in counterpart Australian application No. 2010241192.
Communication dated Nov. 25, 2013, issued by the State Intellectual Property Office of the People's Republic of China in corresponding Application No. 201010559241.1.
Office Action dated Feb. 27, 2014, issued by the Korean Intellectual Property Office in counterpart Korean Application No. 10-2010-0109567.

* cited by examiner

*Primary Examiner* — Joseph S Wong
(74) *Attorney, Agent, or Firm* — Sughrue Mion, PLLC

(57) ABSTRACT

A powder delivery member includes: a rotation shaft portion disposed rotatably within a powder storage container with powder stored therein; a delivery portion for delivering the powder along the axial direction of the rotation shaft portion; and, a powder discharge portion which, is disposed at a position corresponding to the position of the powder discharge port of the powder storage container, and is capable of storing therein the powder delivered thereto from the delivery portion, and also which, when it is rotated along the peripheral direction of the rotation shaft portion with the powder stored therein, can deliver the stored powder to the powder discharge port.

21 Claims, 22 Drawing Sheets

POWDER DELIVERY MEMBER, AND POWDER STORAGE CONTAINER AND IMAGE FORMING APPARATUS RESPECTIVELY USING SUCH POWDER DELIVERY MEMBER

CROSS-REFERENCE TO RELATED APPLICATIONS

This application is based on and claims priority under 35 USC 119 from Japanese Patent Application No. 2010-100796 filed on Apr. 26, 2010.

BACKGROUND

1. Technical Field

The present invention relates to a powder delivery member, and a powder storage container and an image forming apparatus respectively using such powder delivery member.

2. Related Art

An image forming apparatus of the above type is structured such that, in order to supply developer (powder) from a developer storage container with the developer stored therein to a developing device, using a developer delivery member disposed within the developer storage container, the developer is delivered to a developer discharge port while stirring the developer, thereby supplying the developer to the developing device.

SUMMARY

According to an aspect of the invention, a powder delivery member, includes: a rotation shaft portion that is disposed rotatably within a powder storage container with powder stored therein; a delivery portion that delivers the powder along the axial direction of the rotation shaft portion; and a powder discharge portion (i) that is constituted of such end portion of the delivery portion as exists on a downstream side in the delivery direction of the delivery portion, (ii) is disposed at a position corresponding to a powder discharge port of the powder storage container, (iii) is capable of storing therein the powder delivered thereto from the delivery portion and (iv) when being rotated along the peripheral direction of the rotation shaft portion with the powder stored therein, delivers the stored powder to the powder discharge port.

BRIEF DESCRIPTION OF THE DRAWINGS

Exemplary embodiment(s) of the present invention will be described in detail based on the following figures, wherein.

DETAILED DESCRIPTION

Now, description will be given below of exemplary embodiments according to the invention with reference to the accompanying drawings.

Embodiment 1

Figure 2:
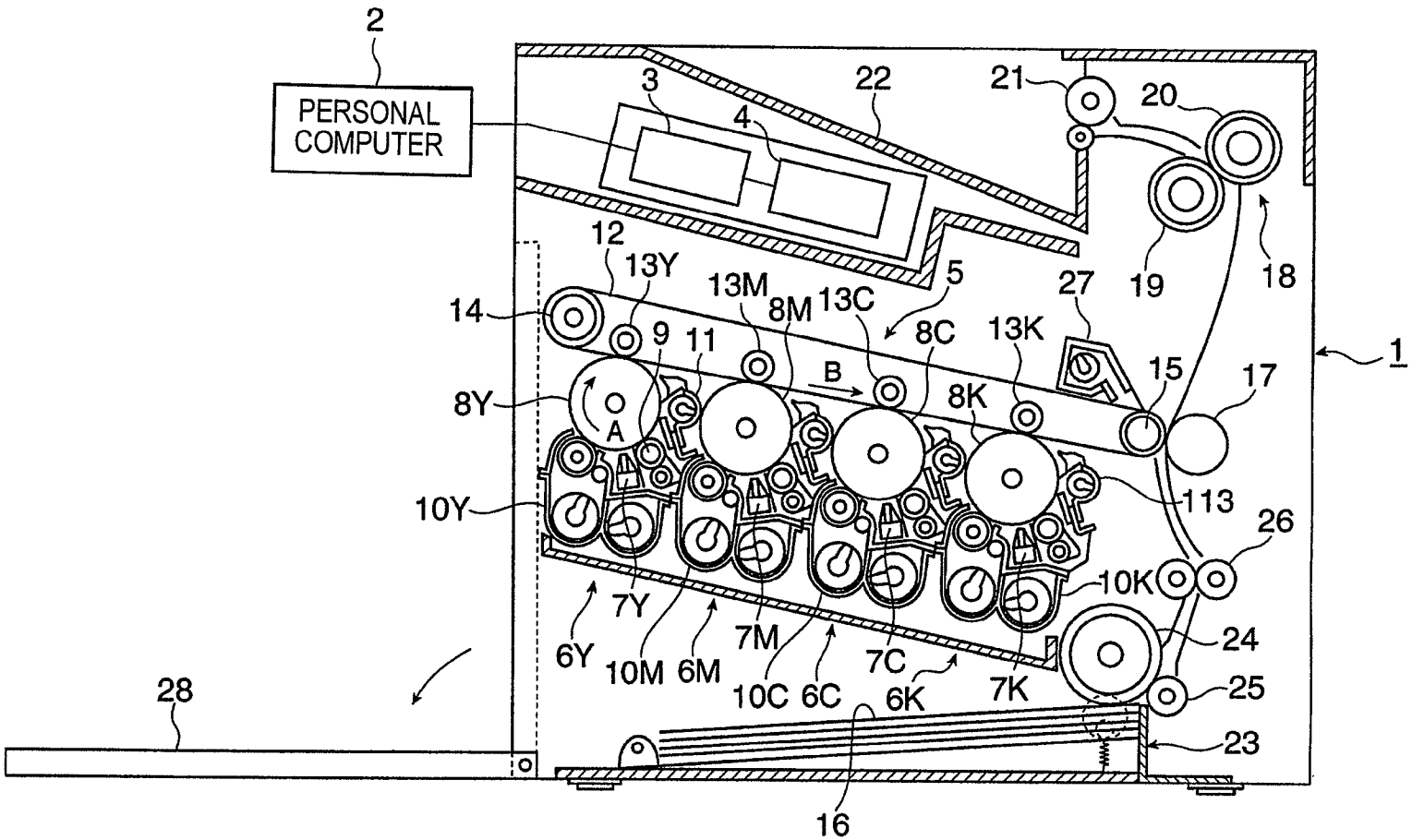
FIG. 2 is a structure view of a tandem-type color printer serving as an image forming apparatus to which there is applied a developing device according to the embodiment 1 of the invention.
Figure 3:
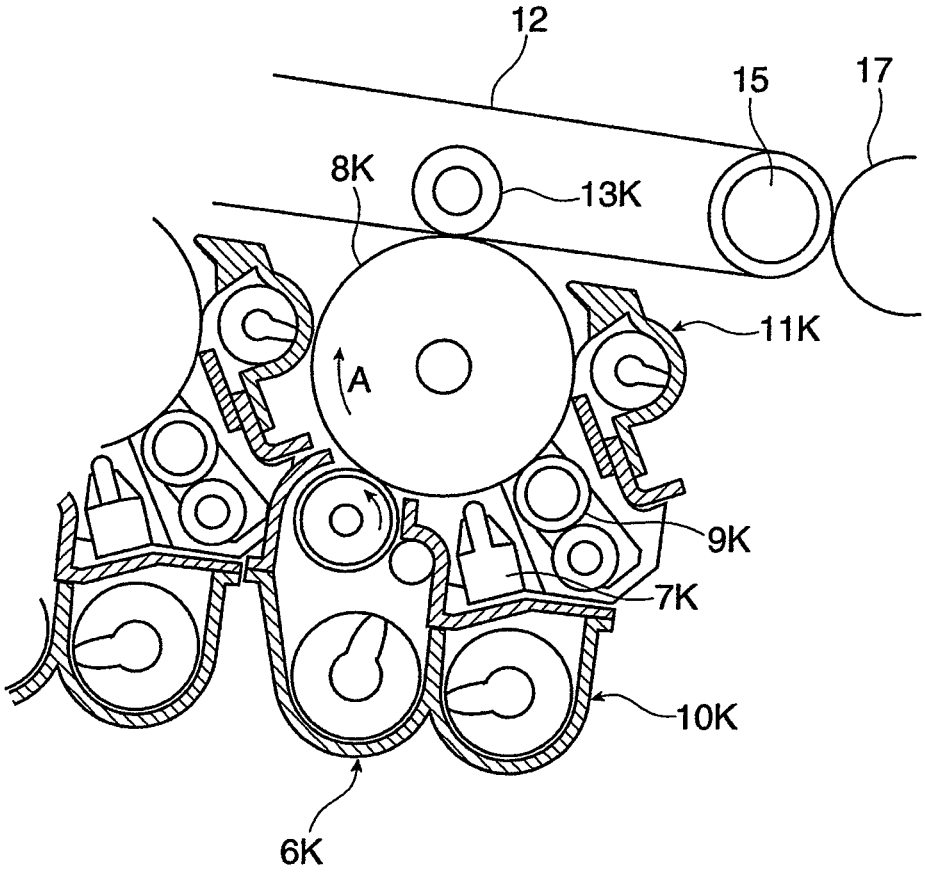
FIG. 3 is a structure view of the image forming portion of the tandem-type color printer serving as an image forming apparatus to which there is applied a developing device according to the embodiment 1 of the invention.

FIG. 2 is a structure view of a tandem-type color printer serving as an image forming apparatus to which there are applied a developer delivery member and a developer storage container respectively according to the embodiment 1 of the invention. Also, FIG. 3 is a structure view of the image forming portion of the color printer.

This color printer, as shown in FIG. 2, receives image data output from a personal computer or an image read device (not shown) or the like, and image data transmitted thereto through a telephone line or a LAN or the like; and, in response to such image data, it outputs a full-color image or a monochrome image.

Figure 4:
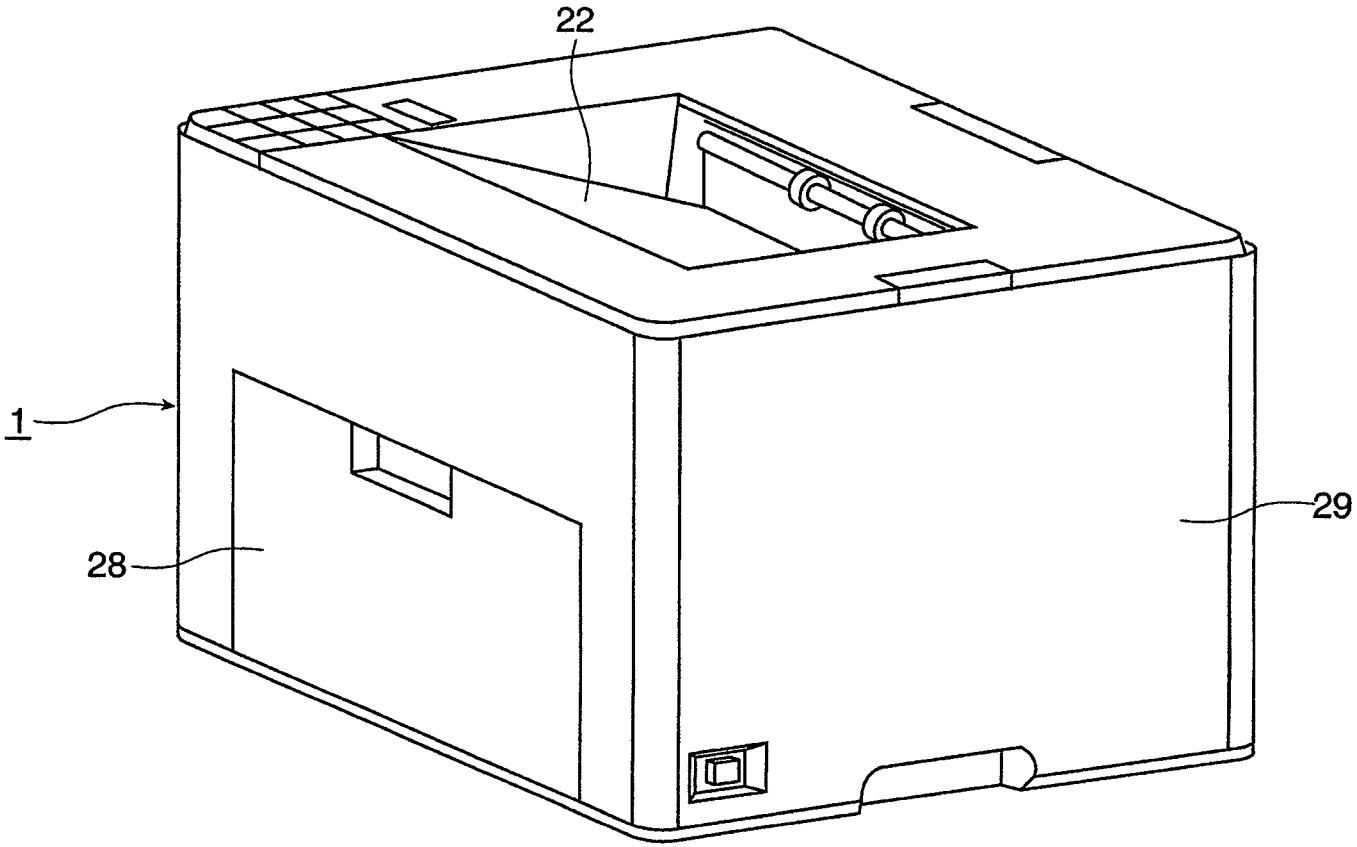
FIG. 4 is an external perspective view of the tandem-type color printer serving as an image forming apparatus to which there is applied a developing device according to the embodiment 1 of the invention.
Figure 5:
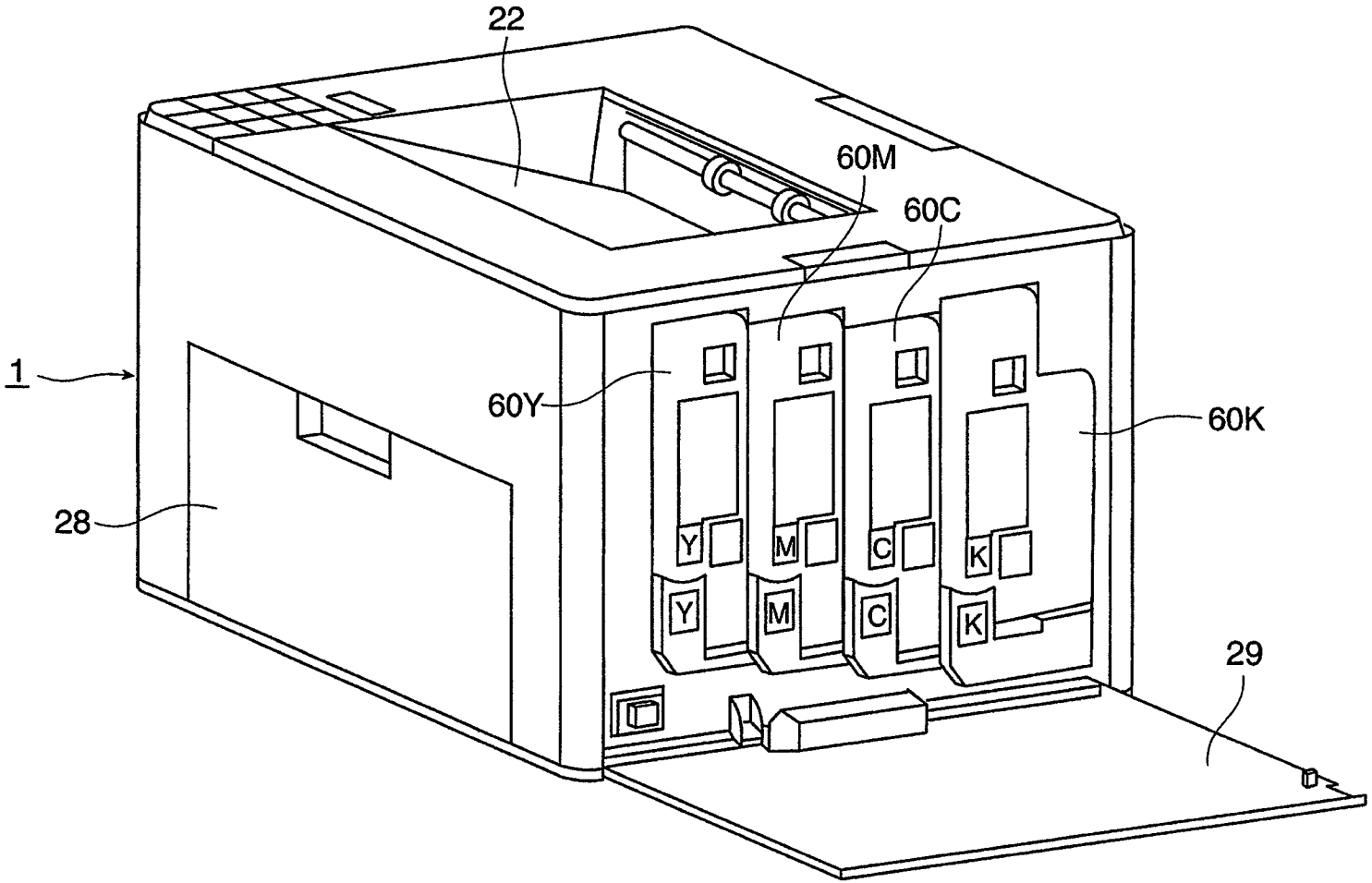
FIG. 5 is an external perspective view of the tandem-type color printer serving as an image forming apparatus to which there is applied a developing device according to the embodiment 1 of the invention, showing a state where a cover is opened.
Figure 6:
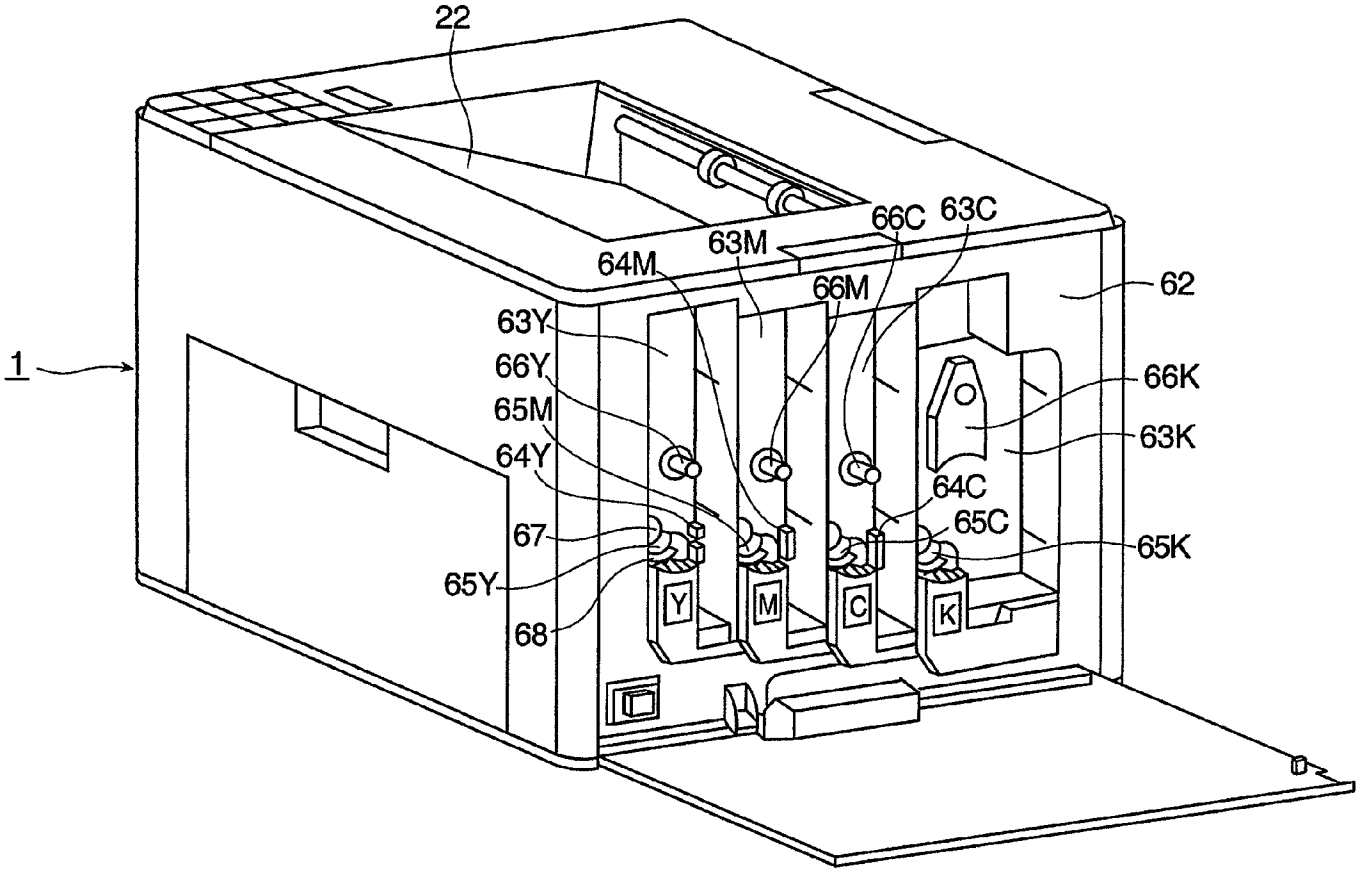
FIG. 6 is an external perspective view of the tandem-type color printer serving as an image forming apparatus to which there is applied a developing device according to the embodiment 1 of the invention, showing a state where a cover is opened.

The main body 1 of the color printer, as shown in FIGS. 4 to 6, is formed in a substantially rectangular parallelepiped shape. On the front surface of the color printer main body 1, there is disposed a front cover 28 which can be opened and closed and also which is used to supply recording paper; and, on one side surface thereof, there is disposed a side cover 29 which can be opened and closed and also which is used to replace toner cartridges 60Y, 60M, 60C and 60K respectively serving as developer storage containers (powder storage containers). Also, on the top portion of the color printer main body 1, there is formed integrally therewith a discharge tray 22 which is used to discharge recording paper on which an image has been formed.

Within the color printer main body 1, as shown in FIG. 2, there are disposed: an image processing portion 3 which, on image data transmitted thereto from a personal computer (PC) 2 and an image read device (not shown) or the like, according to cases, carries out a predetermined image processing such as a shading correcting processing, a position-shift correcting processing, a lightness/color space converting processing, a gamma correcting processing, a frame erasing processing and a color/movement editing processing; and, a control portion 4 which is used to control the operation of the whole of the color printer.

And, the image data, on which the predetermined image processing has been carried out by the image processing portion 3 in the above-mentioned manner, is converted by the same image processing portion 3 to four pieces of color image data, that is, yellow (Y), magenta (M), cyan (C) and black (K). The thus converted image data, as will be described below, is output as a full-color image or a monochrome image from an image output portion 5 formed within the color printer main body 1.

Within the color printer main body 1, as shown in FIG. 2, there are disposed four image forming units (image forming portions) 6Y (for yellow (Y)), 6M (for magenta (M)), 6C (for cyan (C)) and 6K (for black (K)) in parallel at given intervals while they are respectively inclined at a given angle (for example, an angle of about 10 degrees) with respect to the horizontal direction in such a manner that the image forming unit 6Y for the first color, that is, yellow (Y), is situated at a relatively high position and the image forming unit 6K for the last color, that is, black (K), is situated at a relatively low position. Here, the inclination angle of the image forming units 6Y, 6M, 6C and 6K is not limited to the above-mentioned about 10 degrees but, of course, it may also be larger or smaller than this angle.

In this manner, since the four image forming units 6Y, 6M, 6C and 6K respectively for yellow (Y), magenta (M), cyan (C) and black (K) are arranged inclined at a predetermined angle, when compared with a structure in which the four image forming units 6Y, 6M, 6C and 6K are arranged horizontally, the distance between the four image forming units 6Y, 6M, 6C and 6K can be reduced. This can reduce the width of the color printer main body 1 and thus can reduce the size thereof further.

These four image forming units 6Y, 6M, 6C and 6K, basically, are similar in structure to each other except for the color of the image to be formed. As shown in FIGS. 2 and 3, each image forming unit 6 includes mainly: a sensitive drum 8 serving as an image holding member which can be driven and rotated at a predetermined speed along the direction of an arrow mark A by drive unit (not shown); a charging roller 9 for primary charging which is used to charge the surface of the sensitive drum 8 uniformly; an image exposure device 7 constituted of an LED print head which is used to expose an image corresponding to a predetermined color onto the surface of the sensitive drum 8 to thereby form an electrostatic latent image thereon; a developing device 10 for developing the electrostatic latent image formed on the sensitive drum 8 using the toner of the predetermined color; and, a cleaning device 11 for cleaning the surface of the sensitive drum 8.

As the sensitive drum 8, for example, there is used a member which is formed in a drum shape having a diameter of about 30 mm and the surface of which is coated with a sensitive layer constituted of an organic photo conductor (OPC) or the like. And, the sensitive drum 8 can be driven and rotated at a predetermined speed along the arrow mark A direction by a drive motor (not shown).

Also, as the charging roller 9, for example, there is used a roller-shaped charger constituted of a core bar and a conductive layer which is made of synthetic resin or synthetic rubber and the electric resistance of which has been adjusted, while the surface of the core bar is coated with the conductive layer. To the core bar of the charging roller 9, there can be applied a predetermined charging bias.

The above four image exposure devices 7, as shown in FIG. 2, are arranged individually in the respective four image forming units 6Y, 6M, 6C and 6K. As the image exposure devices 7 which are arranged individually in the respective four image forming units 6Y, 6M, 6C and 6K, there are used image exposure devices each of which includes: an LED light emitting element array having multiple LED light emitting elements respectively arranged linearly along the axial direction of the sensitive drum 8 at a predetermined pitch (for example, 600 dpi~1200 dpi); and, a rod lens array for image forming lights respectively emitted from the LED light emitting elements of the LED light emitting array onto the sensitive drum 8 in a spot manner. Also, each of the image exposure devices 7, as shown in FIGS. 2 and 3, is structured such that it scans and exposes the image onto the sensitive drum 8 from below.

Here, when, as the image exposure device 7, there is used a device which is constituted of an LED light emitting array, the image exposure device can be desirably reduced greatly in size. However, the image exposure device 7 is not limited to the device that is constituted of the LED light emitting array, but there may also be used an image exposure device which is structured to deflect and scan a laser beam along the axial directions of the respective sensitive drums 8. In this case, for the our image forming units 6Y, 6M, 6C and 6K, there is arranged a single image exposure device 7.

From the image processing portion 3, there are sequentially output the image data of the respective colors to their corresponding image exposure devices 7Y, 7M, 7C and 7K individually disposed in the image forming units 6Y, 6M, 6C and 6K of the respective colors, yellow (Y), magenta (M), cyan (C) and black (K); and, light beams, which have been emitted from the image exposure devices 7Y, 7M, 7C and 7K according to the image data, are scanned and exposed onto the surfaces of their corresponding sensitive drums 8Y, 8M, 8C and 8K, whereby there are formed thereon electrostatic latent images which correspond to the image data. The electrostatic latent images respectively formed on the sensitive drums 8Y, 8M, 8C and 8K are developed as the toner images of the respective colors, yellow (Y), magenta (M), cyan (C) and black (K) by the developing devices 10Y, 10M, 10C and 10K.

The toner images of the respective colors, yellow (Y), magenta (M), cyan (C) and black (K), which have been formed sequentially on the sensitive drums 8Y, 8M, 8C and 8K of the image forming units 6Y, 6M, 6C and 6K, are primarily transferred multiply one after the other by four primary transfer rollers 13Y, 13M, 13C and 13K onto an intermediate transfer belt 12 serving as an endless belt shaped intermediate transfer member disposed in an inclined manner upwardly of the respective image forming units 6Y, 6M, 6C and 6K in an inclined manner.

The intermediate transfer belt 12 is an endless belt-shaped member carried by and on multiple rollers. And, the intermediate transfer belt 12 is disposed inclined with respect to the horizontal direction in such a manner that the downstream side of the lower side running area of the belt-shaped member along the running direction is situated relatively low and the upstream side thereof is situated relatively high.

That is, the intermediate transfer belt 12, as shown in FIG. 2, is arranged due to a predetermined tensile force on and between a drive roller 15 and a driven roller 14 respectively having the function of the back surface support rollers of a secondary transfer portion. The intermediate transfer belt 12 can be driven and circulated at a predetermined speed along the direction of an arrow mark B shown in FIG. 2 by the drive roller 15 which can be driven and rotated by a drive motor (not shown) having an excellent constant speed characteristic. As the above-mentioned intermediate transfer belt 12, for example, there is used an endless belt which is made of a film formed of flexible synthetic resin such as polyimide or poly amide-imide. The intermediate transfer belt 12 is arranged such that the lower side running area thereof can be contacted with the sensitive drums 8Y, 8M, 8C and 8K of the respective image forming units 6Y, 6M, 6C and 6K.

Also, on the intermediate transfer belt 12, as shown in FIG. 2, there is provided a secondary transfer roller 17 serving as secondary transfer unit which is disposed in the lower side end portion of the running area of the intermediate transfer belt 12 for transferring the toner images primarily transferred on the intermediate transfer belt 12 onto to a recording medium 16 secondarily; and, the secondary transfer roller 17 is arranged such that it can be contacted with the surface of the intermediate transfer roller 12 carried on and by the drive roller 15.

The toner images of the respective colors, that is, yellow (Y), magenta (M), cyan (C) and black (K), which have been multiply transferred on the intermediate transfer belt 12, are transferred secondarily onto the recording paper 16 serving as a recording medium by the secondary transfer roller 17 which can be contacted with the drive roller 15 through the intermediate transfer roller 12; and, the recording paper 16, on which the toner images of the respective colors have been transferred, is then delivered to a fixing device 18 which is disposed upwardly in the vertical direction. The secondary transfer roller 17 is pressure contacted with the lateral portion of the drive roller 15 through the intermediate transfer belt 12 and is able to secondarily transfer the toner images of the respective colors collectively onto the recording paper 16 which is delivered from downward to upward in the vertical direction.

To form the secondary transfer roller 17, for example, there may be prepared a core metal member made of metal such as stainless steel, and the outer periphery of the core metal member may be covered with an elastic layer made of conductive elastic material such as synthetic rubber with a conductive agent added thereto, while the elastic layer has a predetermined thickness.

And, the recording paper 16 with the toner images of the respective colors transferred thereon is processed or fixed due to heat and pressure by the heating roller 19 and pressurizing belt (or a pressurizing roller) 20 of a fixing device and, after then, is discharged by a discharge roller 21 onto a discharge tray 22 provided on the upper end portion of the printer main body 1 in a state where the image surface of the recording paper 16 faces downward.

In the case of the recording paper 16, as shown in FIG. 2, multiple sheets of paper respectively having a predetermined size and made of predetermined material are supplied one by one separately from a paper supply tray 23 disposed in the bottom portion of the printer main body 1, and are delivered once to resist rollers 26, when the delivery thereof is stopped here. And, the recording paper 16 supplied from the paper supply tray 23 is sent out to the secondary transfer position of the intermediate transfer belt 12 by the resist rollers 26 which are driven and rotated in synchronization with the toner images on the intermediate transfer belt 12. As the recording paper 16, there can be used ordinary paper and cardboard such as coat paper on the front surface or on the front and back surfaces of which there has been carried out a coating processing. To the recording paper 16 which is constituted of the coat paper, there can also be output a photographic image and the like.

Here, the surface of the sensitive drum 8, on which the toner image primary transfer operation has ended, as shown in FIGS. 2 and 3, is cleaned by the cleaning device 11 to thereby remove remaining toners therefrom, and then it waits for a next image forming operation. Also, the surface of the intermediate transfer belt 12, on which the toner image secondary transfer operation has ended, as shown in FIG. 2, is cleaned by a belt cleaning device 27 provided downstream in the vicinity of the drive roller 15 to thereby remove remaining toners therefrom, and it waits for a next image forming operation.

Figure 7:
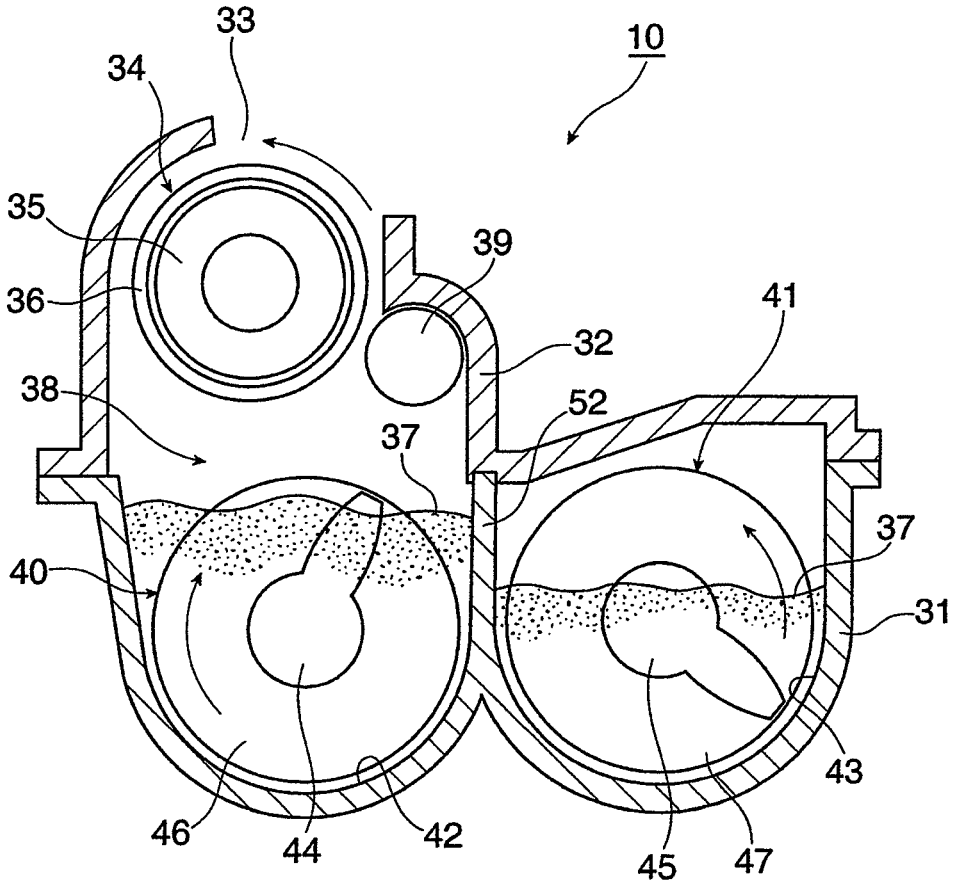
FIG. 7 is a section view of the developing device.

FIG. 7 is a structure view of a developing device which is used in a color printer serving as an image forming apparatus according to the embodiment 1 of the invention.

This developing device 10, as shown in FIG. 7, includes a lower housing 31 and an upper housing 32. In the upper end portion on one side of the upper housing 32, there is formed an opening 33 and, in the opening 33, there is disposed a developing roller 34 serving as a developer holding member (powder holding member). The developing roller 34 includes: a magnet roller 35 disposed such that it is fixed to the interior of the developing roller 34; and, a developing sleeve 36 disposed on the outer periphery of the magnet roller 35 in such a manner that it can be rotated along the direction of an arrow mark shown in FIG. 7.

Also, downwardly of the developing roller 34, there is formed a developer storage chamber 38 which is defined by the upper housing 32 and lower housing 31 in a state where they are combined together and also which is used as a space for storing therein a two-component developer 37 constituted of toners and carriers. Within the upper housing 32, a developer restrict member 39 for restricting the amount of the developer 37 to be supplied to the surface of the developing roller 34 is disposed downstream in the rotation direction of the developing roller 34 and in the vicinity of the opening 33 through a predetermined clearance with respect to the surface of the developing roller 34. This developer restrict member 39 is structured, for example, in such a manner that it can restrict the amount of the developer 37 to be supplied to the surface of the developing roller 34 due to the magnetism thereof; and also, it is formed, for example, of magnetic material such as nickel into a cylindrical shape having a predetermined diameter.

On the other hand, within the lower housing 31, there is stored the two-component developer 37 made of toners and carriers; and, there are also disposed a first stir/delivery auger 40 which delivers the developer 37 while stirring it up to thereby supply it to the surface of the developing roller 34, and a second stir/delivery auger 41 for delivering the developer 37 while stirring it up. The developer storage chamber 38, which is constituted of the interior of the lower housing 31, is divided by a partition wall 52 into a first stir/delivery auger storage chamber 42 for storing therein the first stir/delivery auger 40 and a second stir/delivery auger storage chamber 43 for storing the second stir/delivery auger 41 therein.

Figure 8:
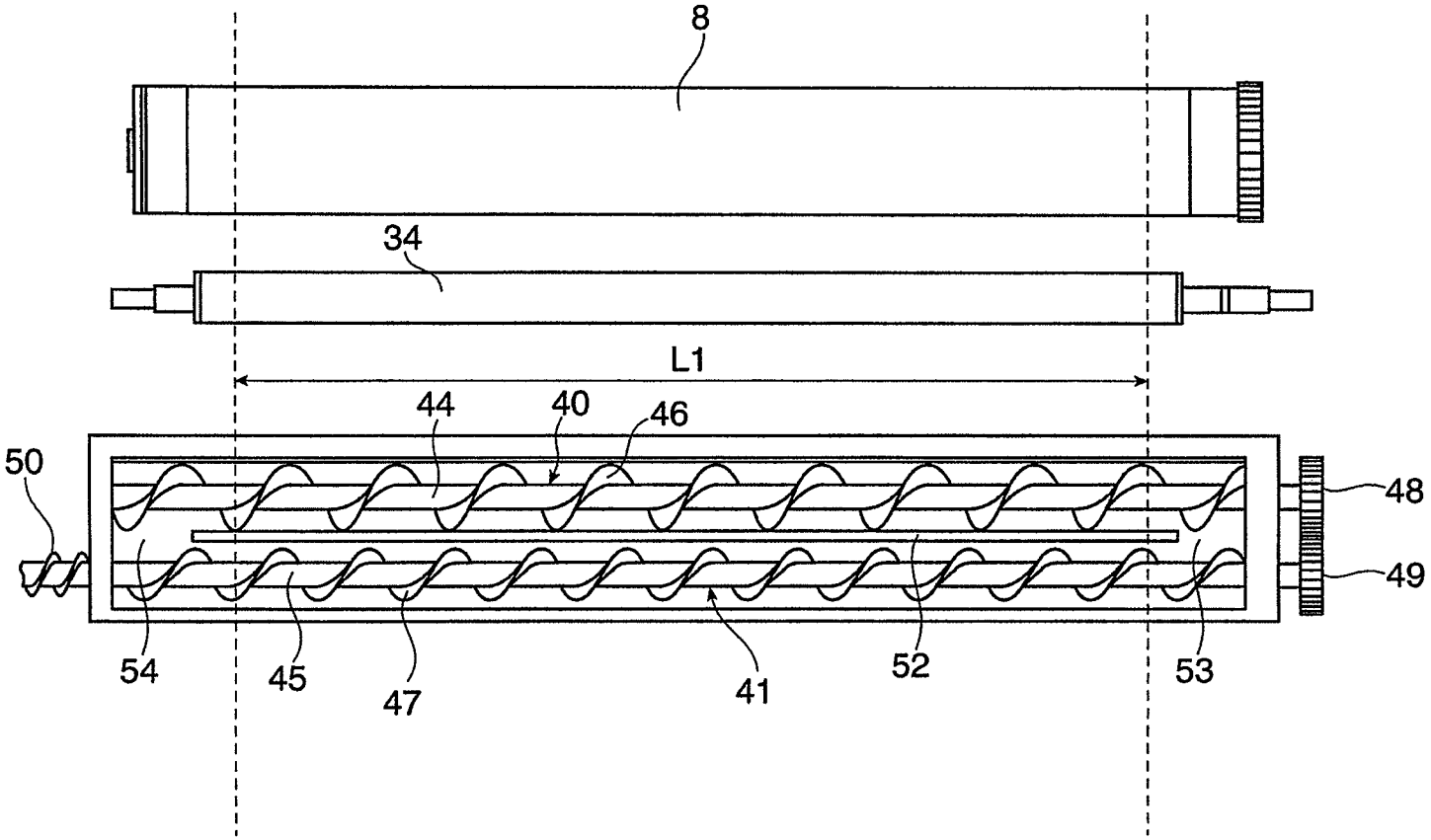
FIG. 8 is an exploded plan view of the developing device.

Also, the first and second stir/delivery augers 40 and 41, as shown in FIG. 8, are respectively constituted of rotation axes 44 and 45 each formed to have a cylindrical shape, and stir/delivery vanes 46 and 47 respectively provided on the outer peripheries of the rotation axes 44 and 45 in a spiral manner; and, they are structured such that they deliver the developer 37 while stirring it up in the mutually opposite directions.

The first and second stir/delivery augers 40 and 41, as shown in FIG. 8, can be driven or rotated respectively by their associated gears 48 and 49 which are respectively mounted on one-end portions of the rotation shafts 44 and 45.

Figure 9:
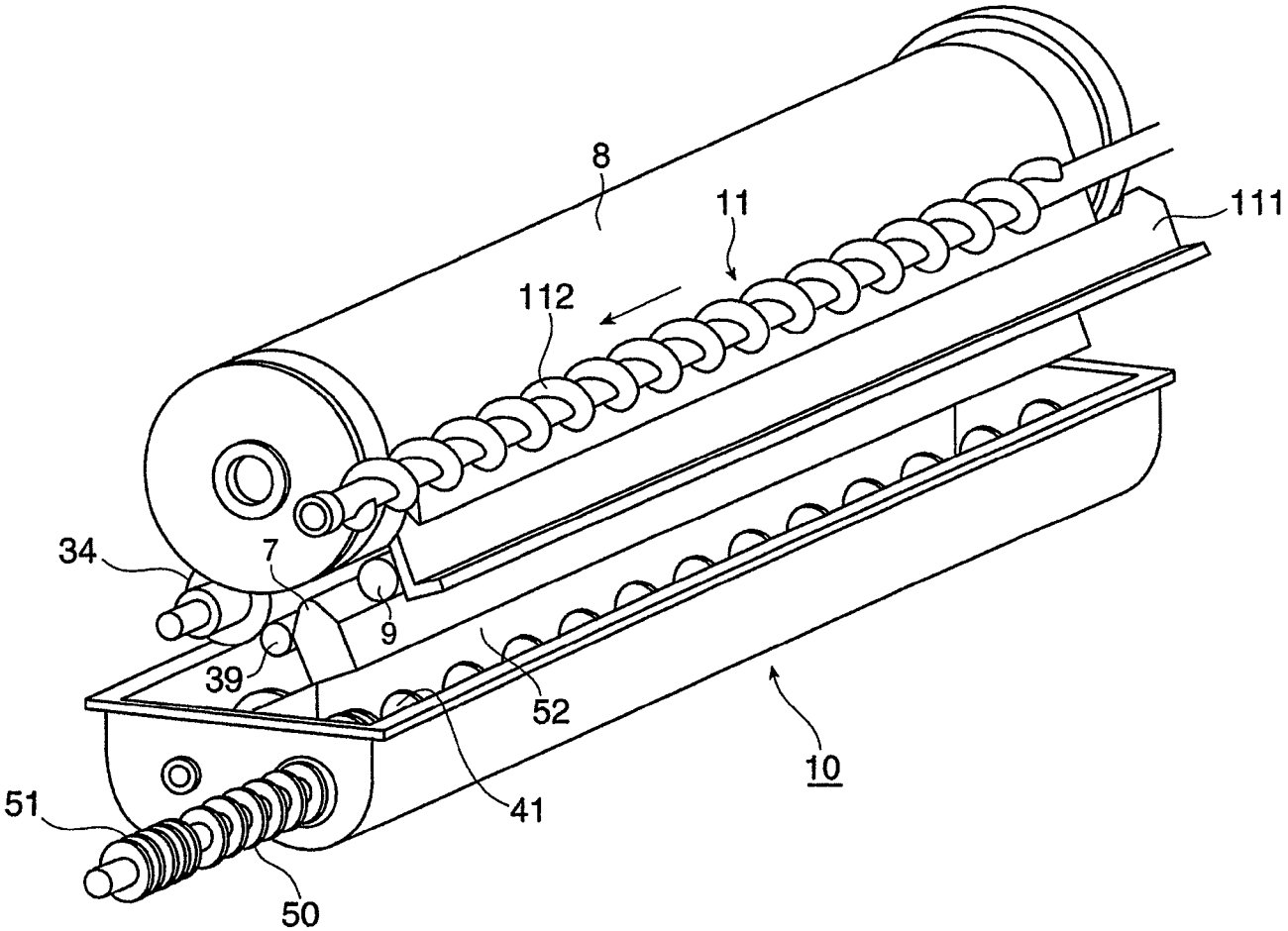
FIG. 9 is a perspective structure view of an image forming unit.

Into the developing device 10, as shown in FIG. 9, there is supplied a new developer containing at least toners from the toner cartridges 60Y, 60M, 60C and 60K by an auger 50 which is extended toward one end portion (in FIG. 9, toward this side) along the axial direction of the second stir/delivery auger 41 and is used to supply a developer. On the end portion of this developer supply auger 50, as the need arises, there can be provided integrally therewith a leakage preventive vane 31 which is used to prevent the developer against leakage.

Also, the cleaning device 11 for cleaning the surface of the sensitive drum 8, as shown in FIG. 9, includes a cleaning blade 111 contactable with the surface of the sensitive drum 8, and a collecting auger 112 for collecting toners removed from the surface of the sensitive drum 8 using the cleaning blade 111. The outer periphery of the collecting auger 112, as shown in FIG. 2, is covered with a waste toner delivery member 113 formed to have a semi-cylindrical shape the sensitive drum 8 side portion of which is formed open. And, the cylindrically formed leading end portion of the waste toner delivery member 113, as shown in FIG. 6, is disposed such that it projects onto the side surface of the printer main body 1.

Also, within the developing device 10, as shown in FIG. 8, there is provided a partition plate 52 for separating the first and second stir/delivery auger storage chambers 42 and 43 from each other; and also, on the two end portions of the partition plate 52 along the longitudinal direction thereof, there are formed circulating passages 53 and 54 which can exchange the developer 37 between the first and second stir/delivery auger storage chambers 42 and 43 to thereby circulate the developer 37.

Here, referring to a structure for supplying a new developer into the developing device 10, there may also be employed another structure in which the developer is fallen down onto the circulating passage 54 or onto the end portion of the second stir/delivery auger 41 by the developer supply auger 51.

According to the present embodiment, as shown in FIG. 5, on the side surface of the color printer main body 1, which is exposed to the outside when the side cover 29 is opened, there are mounted the toner cartridges 60Y, 60M, 60C and 60K respectively serving as developer storage containers which store therein their respective developers 61 of the respective colors, that is, yellow (Y), magenta (M), cyan (C) and black (K) containing at least toners; and, from the toner cartridges 60Y, 60M, 60C and 60K, there are supplied the developers 61 containing at least toners to the developing devices 10Y, 10M, 10C and 10K of the corresponding colors. According to the present embodiment, within the toner cartridges 60Y, 60M, 60C and 60K, as the developers, there are stored the developers 61 (containing only the toners). However, of course, there may also be stored developers 61 which are respectively constituted of toners and carriers. The toner cartridges 60Y, 60M, 60C and 60K are basically formed to have the same shape. However, the toner cartridge 60K of black (K) is, in fact, formed larger in size than the other toner cartridges 60Y, 60M and 60C respectively of the other colors.

On one side surface of the color printer main body 1, as shown in FIG. 6, there is provided a cartridge storage frame 62 on which the toner cartridges 60Y, 60M, 60C and 60K of the respective colors, that is, yellow (Y), magenta (M), cyan (C) and black (K) can be removably mounted. In this cartridge storage frame 62, in order to mount the toner cartridges 60Y, 60M, 60C and 60K of the respective colors, that is, yellow (Y), magenta (M), cyan (C) and black (K), there are formed four mounting recessed portions 63Y, 63M, 63C and 63K which correspond in shape to the toner cartridges 60Y, 60M, 60C and 60K respectively. Of these four mounting recessed portions 63Y, 63M, 63C and 63K, in the mounting recessed portions 63Y, 63M and 63C respectively for mounting the toner cartridges 60Y, 60M and 60C therein, there are provided wrong mounting preventive projections 64Y, 64M and 64C which are different in shape from each other and are used to prevent the wrong mounting of the toner cartridges of the other colors.

Within the mounting recessed portions 63Y, 63M, 63C and 63K, there are formed developer supply portions 65Y, 65M, 65C and 65K which supply the developers 61 of the respective colors, that is, yellow (Y), magenta (M), cyan (C) and black (K) respectively, and also developer collect portions 66Y, 66M, 66C and 66K which are used to collect waste toners from the cleaning devices 11Y, 11M, 11C and 11K of the respective colors, that is, yellow (Y), magenta (M), cyan (C) and black (K) respectively. Of the developer collect portions 66Y, 66M, 66C and 66K, the developer collect portion 66K for black (K) is formed larger in size than the other developer collect portions 66Y, 66M, 66C in order that it can collect the waste toner from the cleaning device 11K of the sensitive drum 8K and also can collect the waste toner from the cleaning device 27 of the intermediate transfer belt 12.

Figure 23:
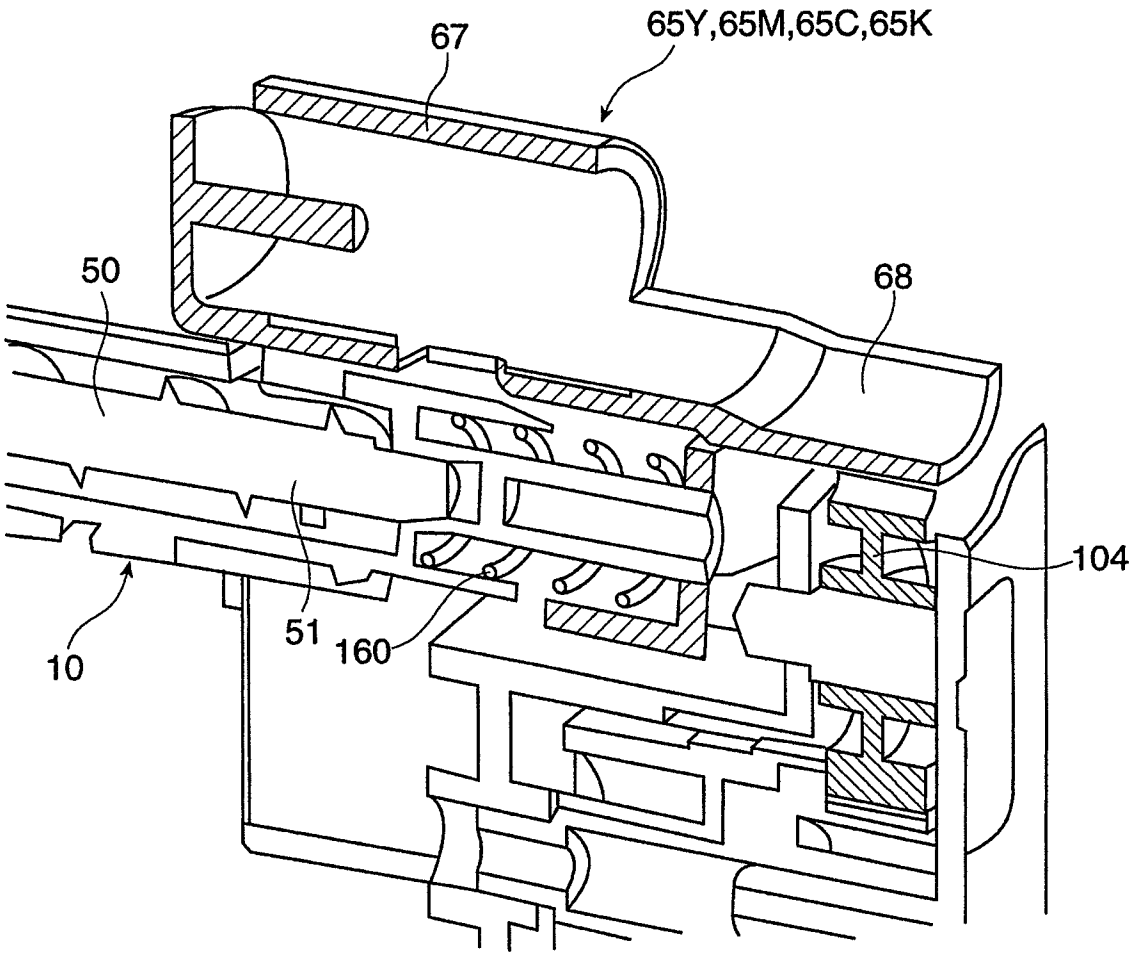
FIG. 23 is a perspective structure view of a developer supply portion.

On the other hand, the developer supply portions 65Y, 65M, 65C and 65K, as shown in FIGS. 6 and 23, respectively include cylindrical-shaped developer receive portions 67 for mounting thereon developer supply cylindrical portions (which will be discussed later) respectively formed in the toner cartridges 60Y, 60M, 60C and 60K, and introduction portions 68 each formed in a semi-cylindrical shape the upper portion of which is formed open on this side of the developer receive portion 67. Here, the developer supply portions 65Y, 65M, 65C and 65K, as shown in FIG. 23, in a state where the toner cartridges 60Y, 60M, 60C and 60K are removed, are respectively energized by springs 160 provided on the leading end portions of their respective developing devices 10 and thus are projected up into a state where they cover a drive gear 104 (which will be discussed later).

Also, the developer collect portions 66Y, 66M, 66C and 66K, as shown in FIG. 6, are respectively constituted of the leading end portions of the waste toner delivery members 113, which, on this side of the cleaning devices 11 of the image forming units 6Y, 6M, 6C and 6K, are projected from the inner surfaces of the mounting recessed portions 63Y, 63M, 63C and 63K. And, in the lower end faces of the leading end portions of the developer collect portions 66Y, 66M, 66C and 66K, there are formed waste toner discharge ports (not shown) which are respectively formed to open downward.

Figure 10:
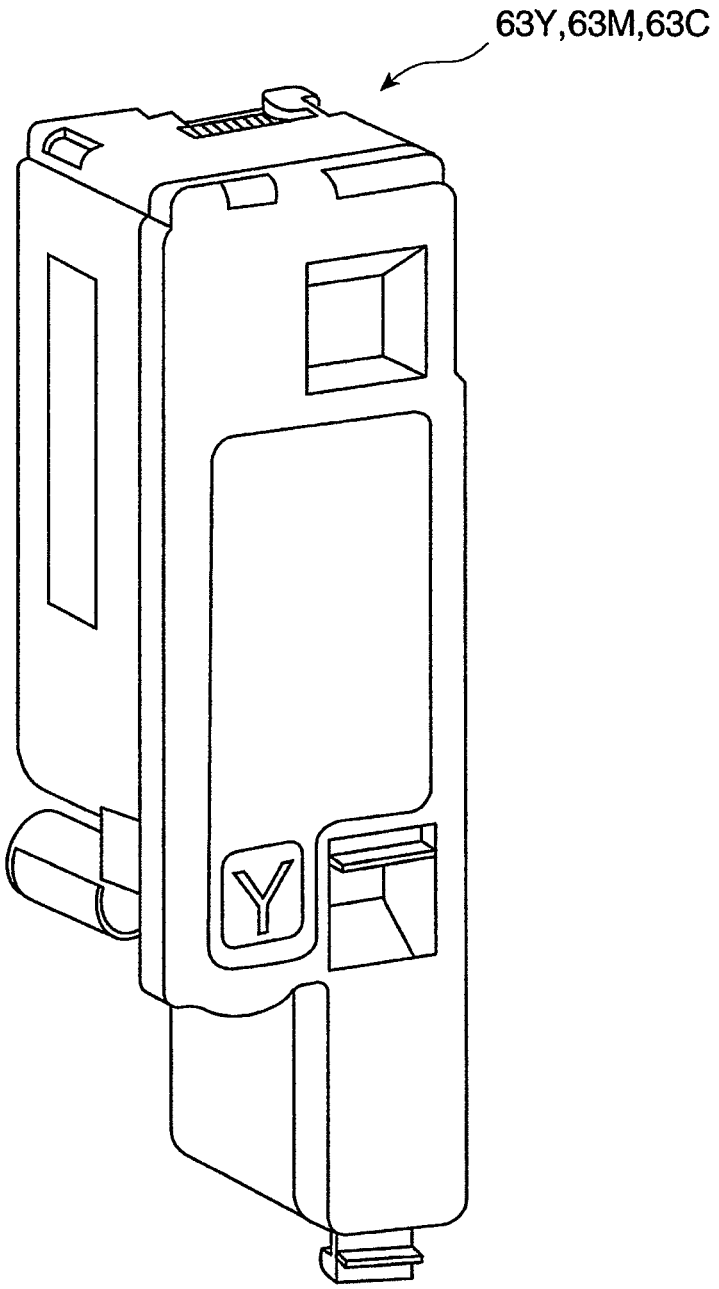
FIG. 10 is a perspective structure view of a toner cartridge.

Here, of the toner cartridges 60Y, 60M, 60C and 60K serving as developer storage containers according to the present embodiment, the toner cartridges 60Y, 60M and 60C of colors, that is, yellow (Y), magenta (M) and cyan (C), as shown in FIG. 10, is formed as a substantially rectangular parallelepiped box body narrow and long in the longitudinal direction. Also, the toner cartridge 60K for black (K), as shown in FIG. 5, is formed to have a large size the width of which is larger than those of the toner cartridges 60Y, 60M and 60C of the other colors.

Figure 11:
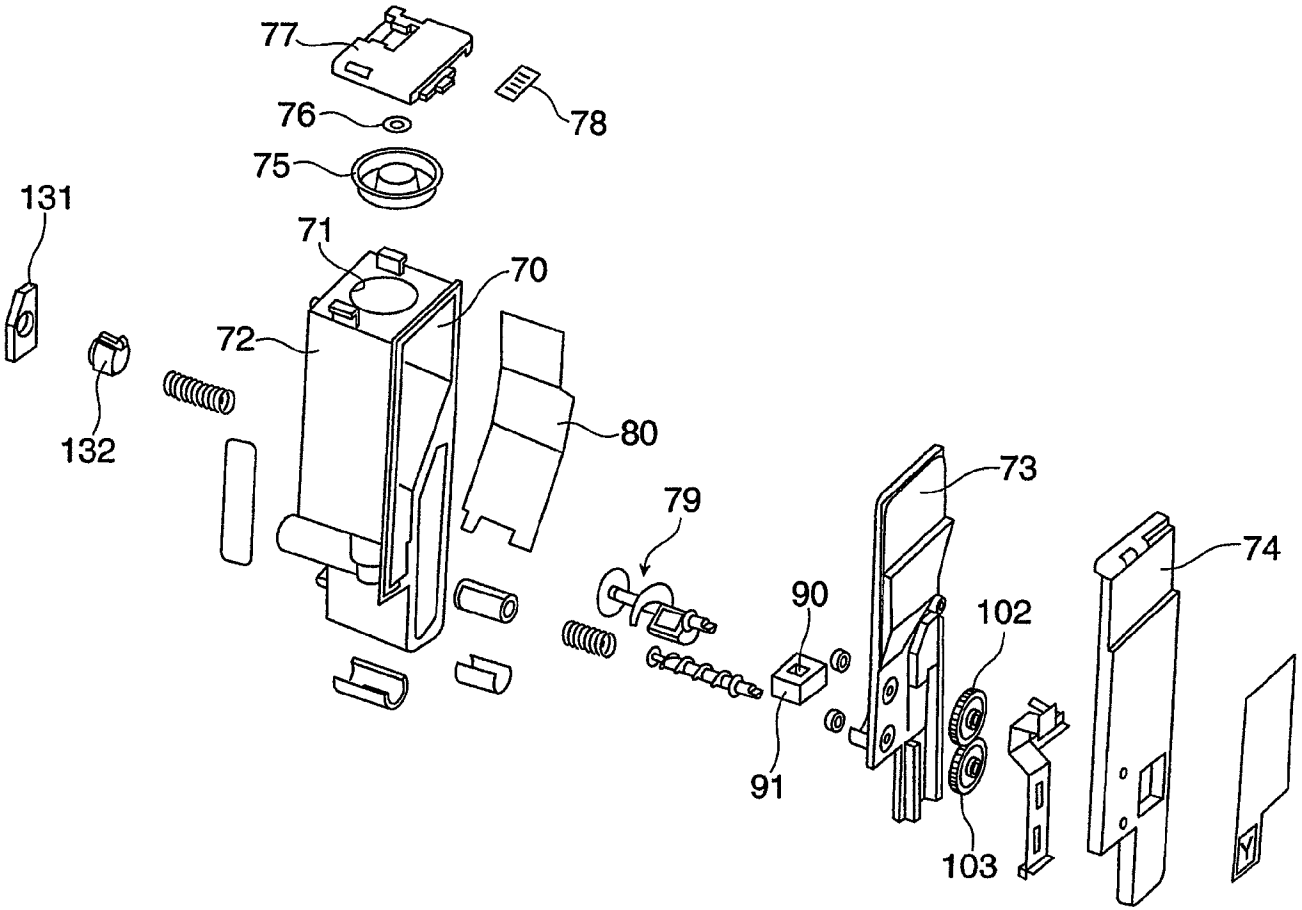
FIG. 11 is an exploded perspective structure view of a toner cartridge.

The toner cartridge 60, as shown in FIG. 11, includes mainly: a container main body 72 which is formed as a substantially rectangular parallelepiped box body narrow and long in the longitudinal direction, one side surface 70 of which is formed to open over the entire area thereof, and also which includes an opening 71 formed in the upper end portion thereof for supplying toners; an inner cover member 73 which is so provided as to close one side surface of the container main body 72; an outer cover member 74 provided on the surface of the inner cover member 73; a seal member 76 which is used to seal a cap member 75 for closing the toner supply opening 71 of the container main body 72 and also seal air holes; an upper cover 77 to be mounted on the upper end portion of the container main body 72; a memory element 78 which is mounted within the upper cover 77, which stores therein data on the toner cartridge 60, and also which can be read from outside; a delivery auger 79 serving as a stir/delivery member which can deliver the developer 61 stored within the container main body 72 to a discharge port while stirring it up; and, a plate-shaped elastic member 80 to be disposed within the container main body 72.

Figure 12:
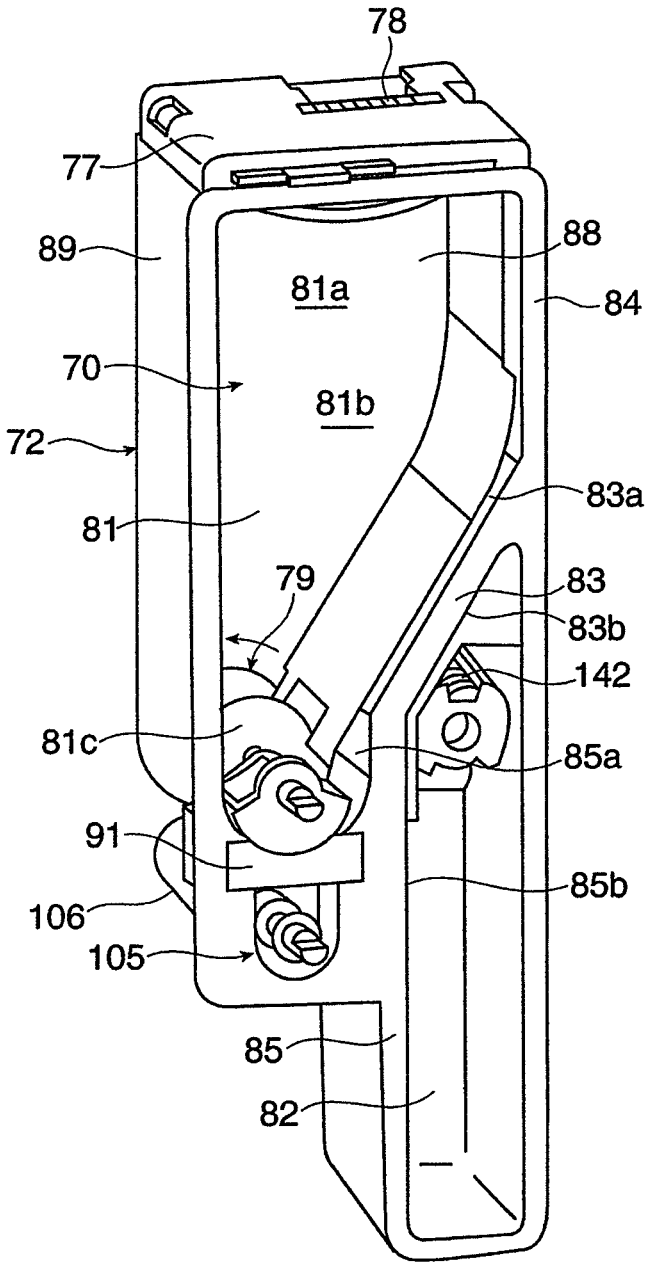
FIG. 12 is a perspective structure view of a toner cartridge.

The container main body 72 of the toner cartridge 60, as shown in FIG. 12, is formed as a substantially rectangular parallelepiped box body which is narrow and long in the longitudinal direction thereof, and includes the opening 70 which is open over the entire surface of one side surface (front surface) of the container main body 72. The interior of the container main body 72 is divided to a new developer storage chamber 81 for storing a new developer 61 therein and a waste developer collect chamber 82 for collecting the developer to be wasted by a partition wall 83 which is disposed inclined from one side wall 84 of the middle portion within the container main body 72 toward the other side wall 89. This partition wall 83 is formed of double walls, that is, a partition wall 83*a* existing on the new developer storage chamber 81 side and a partition wall 83*b* on the waste developer collect chamber 82 side. The partition wall 83*a* is arranged to continue with the lower end portion of one side wall 84 defining the new developer storage chamber 81 and, in FIG. 12, is inclined in the left obliquely downward direction; and, the lower end portion of the partition wall 83*a* is disposed opposed to the side wall 84 of the new developer storage chamber 81 and is also disposed to continue with the upper end portion of a side wall 85 defining the waste developer storage chamber 82. This side wall 85 as well, similarly to the partition wall 83, is constituted of double walls, that is, a side wall 85*a* existing on the new developer storage chamber 81 side and a side wall 85*b* on the waste developer storage chamber 82.

Here, in the illustrated embodiment, the new developer storage chamber 81 occupies about ¾~⅔ of the whole length of the toner cartridge 60, while the waste developer storage chamber 82 occupies about ¼~⅓. However, of course, the ratio of the capacities of the new developer storage chamber 81 and waste developer storage chamber 82 may also be set for other ratio. Also, the waste developer storage chamber 82 may not be formed but the whole interior of the toner cartridge 60 may also be formed as the new developer storage chamber 81.

The new developer storage chamber 81 and waste developer storage chamber 82 of the toner cartridge 60, as shown in FIG. 11, are closed by the inner cover member 73 for closing the opening 70 of the contain main body 72. The inner cover member 73, as shown in FIG. 12, is mounted through wall members constituted of the side wall 84 and partition wall 83 respectively provided on the inner and outer peripheries of the opening 70 in a state where it is so fixed as to close the entire surface of the opening 70 of the container main body 72 using supersonic welding or the like. In this case, in order that the welding portion of a supersonic welding apparatus can be inserted also into the back surface of the partition wall 33 for dividing the container main body 72 to the new developer storage chamber 81 and waste developer storage chamber 82, the back surface sides of the partition wall 83 and side wall 85 respectively interposed between the new developer storage chamber 81 and waste developer storage chamber 82, as shown in FIG. 13, are separated from each other by a separation groove 86.

Figure 13:
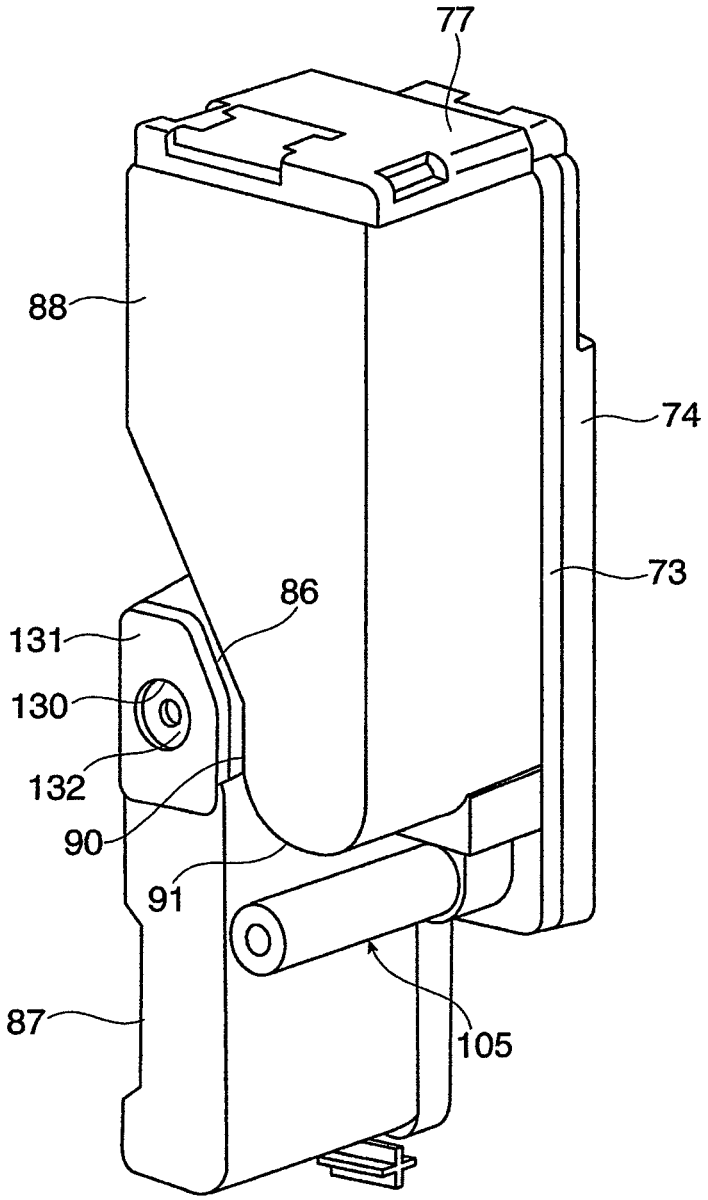
FIG. 13 is a perspective structure view of a toner cartridge.

Here, reference numeral 87 shown in FIG. 13 designates a recessed portion having a shape which corresponds to the wrong mounting preventive projections 64Y, 64M and 64C of the color toner cartridges 60Y, 60M and 60C.

In the case of the new developer storage chamber 81, as shown in FIG. 12, the four side walls 84, 88, 89 and 73 thereof including the cover member 73 for closing the opening 70 are arranged vertically along the vertical direction from the upper end portion thereof to the lower end portion thereof. Also, the side wall 84 is so provided as to extend from the upper end portion of the new developer storage chamber 81 to the middle portion thereof and, in the lower end portion of the side wall 84, there is provided a partition wall 83*a* in such a manner that it is inclined and continues with the side wall 84. The lower end portion of the partition wall 83*a* is situated in the middle portion of the new developer storage chamber 81 along the width direction thereof; and, in the lower end portion of the partition wall 83*a*, there is provided a short side wall 85*a* which is disposed opposed to the side wall 89. Further, in the lower end portions of the side wall 89 and side wall 85*a*, as shown in FIG. 13, there is formed a bottom wall 91 which is formed to have a substantially arc-like shape.

As a result of this, the new developer storage chamber 81, as shown in FIG. 12, includes: an upper end portion 81*a* constituted of the four side walls 84, 88, 89 and 73 in such a manner as to have a width equal to the whole width of the container main body 72; a middle portion 81*b* formed such that its width narrows gradually toward one side wall 89; and, a lower end portion 81*c* so constituted of one side wall 89, side wall 85*a* and bottom wall 91 as to have a substantially U-like section shape. In the case of the new developer 61 stored within the new developer storage chamber 81, as will be discussed later, when it is supplied gradually to the developing device 10, it falls down gradually due to gravity from the upper end portion 81*a* of the new developer storage chamber 81 through the middle portion 81*b* thereof down to the lower end portion 81*c*.

In the lower end portion 81*c* of the new developer storage chamber 81, as shown in FIG. 12, there is provided a delivery auger 79 serving as a developer delivery member which can be rotated along the direction of an arrow mark shown in FIG. 12. Specifically, the delivery auger 79 delivers the developer 61 stored within the new developer storage chamber 81 while stirring it up, and supplies the developer 61 to the outside from a discharge port 90 formed in the bottom portion of the lower end portion 81*c* on this side (opening 70 side) in the depth direction thereof.

Figure 1:
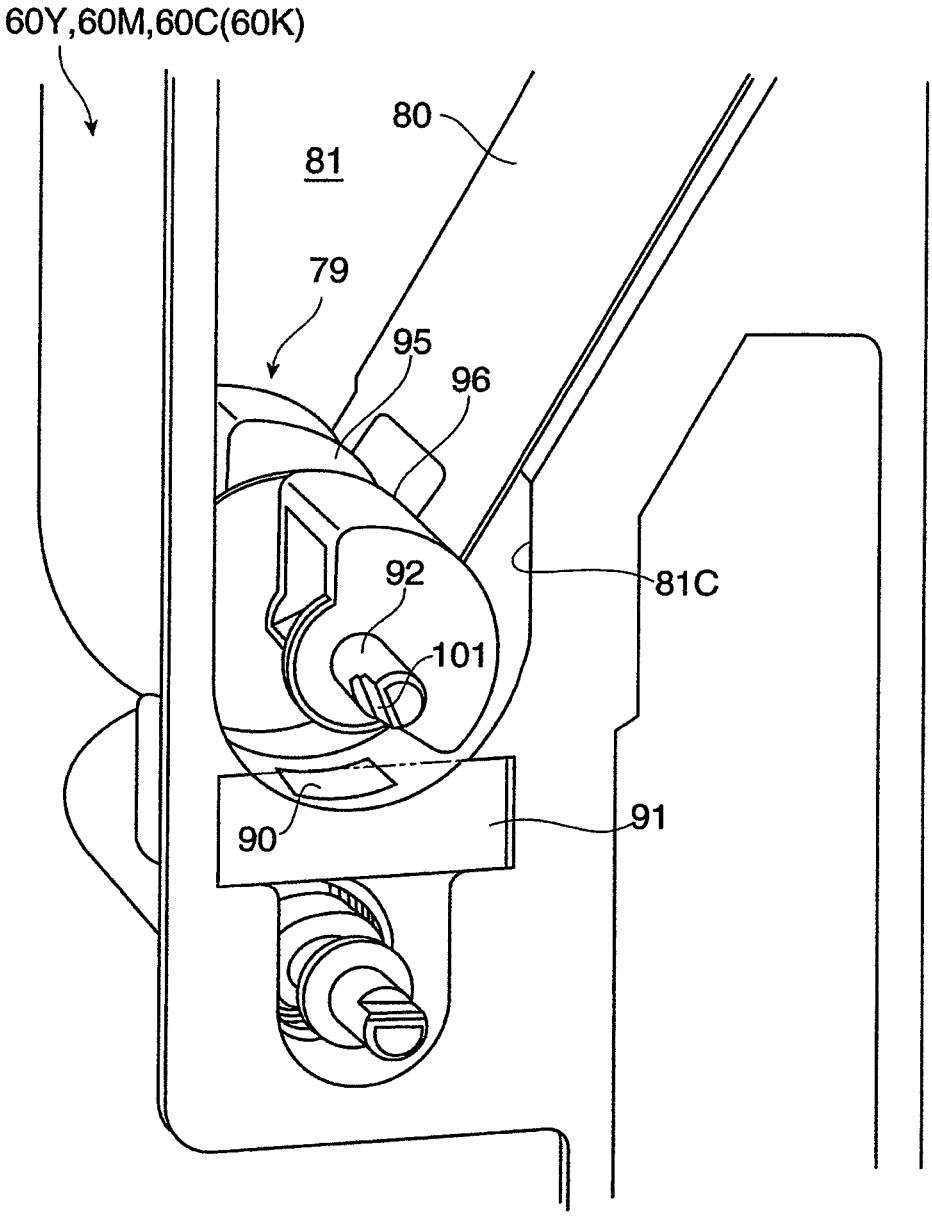
FIG. 1 is a perspective structure view of the main portions of a developer storage container to which there is applied a developer delivery member according to an embodiment 1 of the invention.

The discharge port 90, which is formed in the bottom portion of the lower end portion 81*c* of the new developer storage chamber 81, as shown in FIG. 1, is formed such that it is opened up in a rectangular shape in a discharge port forming member 91 made of an elastic member such as a sponge formed in a rectangular parallelepiped shape. The discharge port forming member 91 is mounted in a state where it is fitted into a recessed portion 92 formed at a position corresponding to the lower end portion 81*c* of the new developer storage chamber 81 of the container main body 72. The upper end face of the discharge port forming member 91, when the toner cartridge 60 is shipped, can be deformed to a shape corresponding to the shape of the outer periphery of the deliver auger 79 to thereby prevent the leakage of the developer 61 while the discharge port 90 is closed by such upper end face. This eliminates the need for use of a seal member or the like which is used to close the discharge port 90 when it is not in use, thereby being able to reduce the number of parts. Here, the new toner cartridges 60Y, 60M, 60C and 60K, when the color printer is shipped, as shown in FIG. 5, are preinstalled and thus are previously mounted on the printer main body 1. Also, in FIG. 1, for convenience, there is shown a state where the upper end face of the discharge port forming member 91 is deformed to a recess-like shape corresponding to the shape of the outer periphery of the delivery auger 79. However, the discharge port forming member 91, as described above, is made of an elastic member such as a sponge and, in a state where the delivery auger 79 is shifted from the discharged port 90, as shown by a two-dot chained line in FIG. 1, the upper end face of the discharge port forming member 91 is returned to the flat shape thereof. Therefore, since the discharge port 90 formed in the discharge port forming member 91 repeats its elastic deformation and return whenever the developer discharge portion 96 (powder discharge portion) of the delivery auger 79 passes, the occurrence of the clogged state of the developer 61 within the discharge port 90 due to the vertical motion of the discharge port forming member 91, that is, due to the pumping operation thereof can be prevented effectively.

Figure 15A:
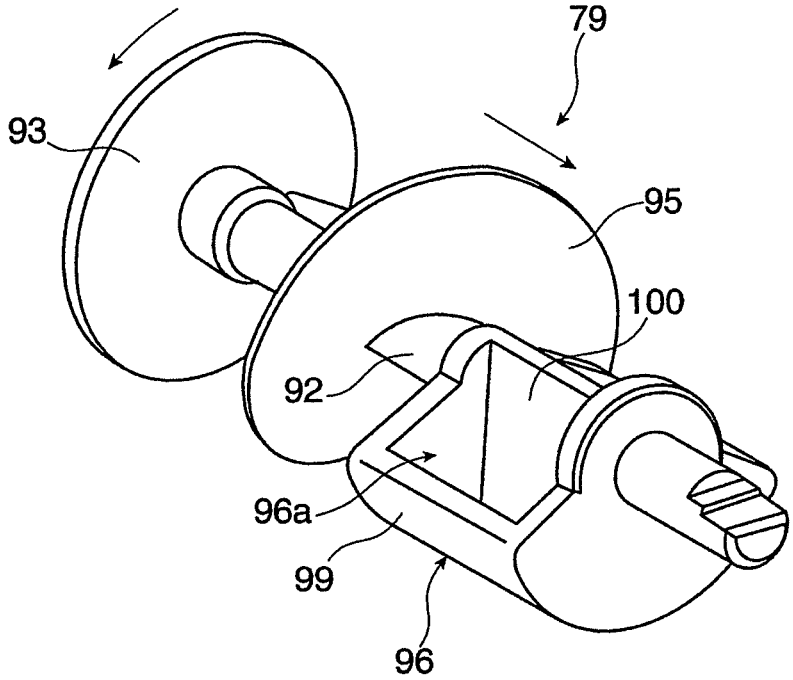
FIGS. 15A and 15B are perspective structure views of a developer delivery member according to the embodiment 1 of the invention.
Figure 15B:
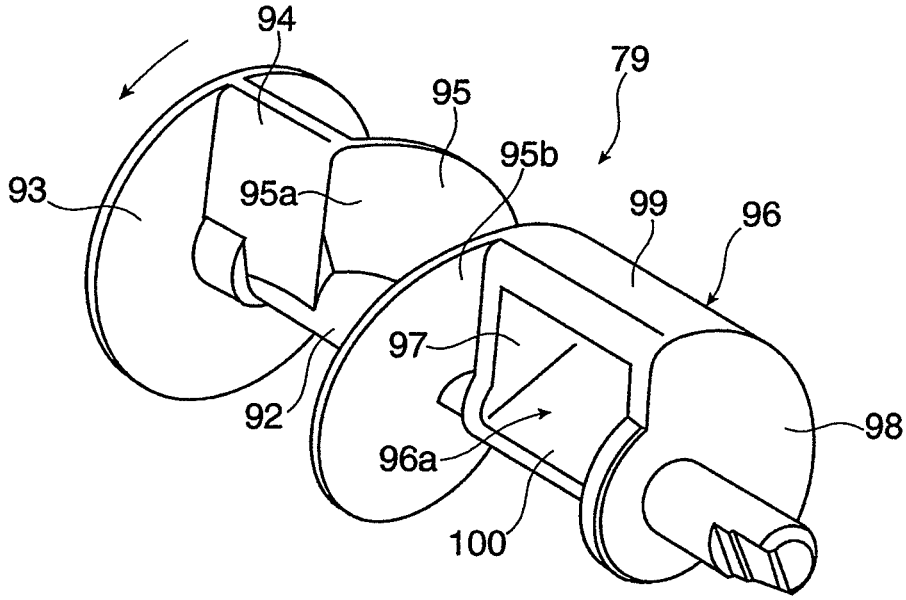

Here, the delivery auger 79 according to the present embodiment, as shown in FIGS. 15A and 15B, is formed of synthetic resin or the like in an integral body. Specifically, the delivery auger 79 includes: a cylindrical-shaped rotation shaft portion 92 disposed in the center of the delivery auger 79 along the delivery direction thereof; a disk-shaped support portion 93 disposed on the upstream side end portion of the rotation shaft portion 92 in the delivery direction (axial direction) thereof; a stirring portion 94 provided upstream of the rotation shaft portion 92 and projected outwardly in the radial direction thereof in a flat plate shape having a radius equal to the disk-shaped support portion 93; a delivery vane portion 95 serving as a delivery portion which is provided spirally on the outer periphery of only the middle portion of the rotation shaft portion 92 and is used to deliver the developer 61; and, a bucket-shaped (saucer-shaped) developer discharge portion 96 disposed downstream of the rotation shaft portion 92 along the delivery direction thereof for discharging the developer 61 into the discharge port 90.

Figure 14:
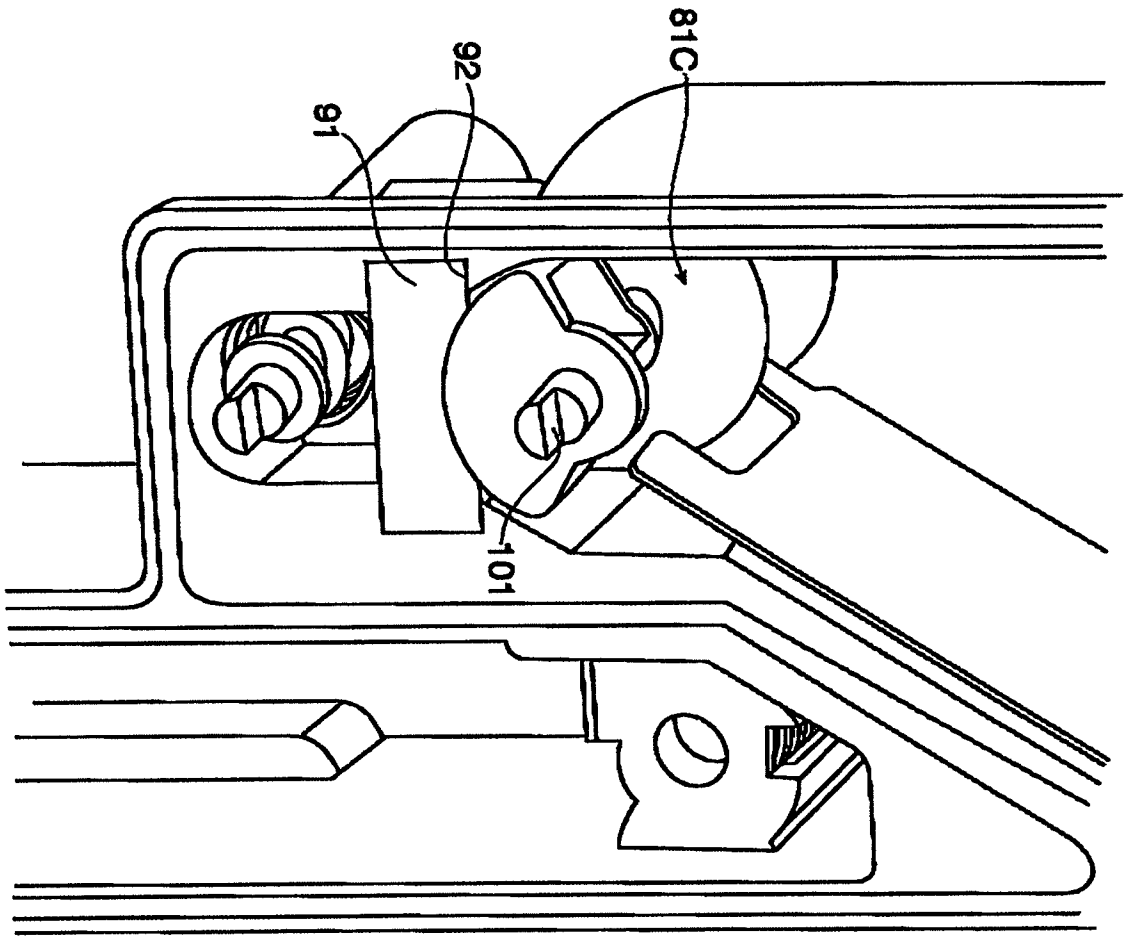
FIG. 14 is a perspective structure view of the main portions of a toner cartridge.

The developer discharge portion 96, as shown in FIGS. 15A and 15B, is formed to have a substantially bucket-like shape and includes: a pair of fan-shaped side plates 97 and 98 which are disposed in the downstream side end portion of the developer discharge portion 96 along the delivery direction thereof, while they are parallel to each other at a predetermined interval along the axial direction of the developer discharge portion 96; an outer peripheral plate 99 which is formed to have an arc shape and is used to cover the outer peripheral surfaces of the paired fan-shaped side plates 97 and 98; and, a partition plate 100 which is disposed in such central portion of the interior of the developer discharge portion 96 as extends along the peripheral direction of the side plates 97 and 98, and also which extends along the radial direction of the developer discharge portion 96. The center angles of the fan-shaped side plates 97 and 98 are respectively set, for example, for about 120 degrees. However, they may also be set for an angle which is larger or smaller than the angle of 120 degrees. In the upper end face of the developer discharge portion 96, there is formed an opening 96*a* the whole surface of which is open in the direction of the rotation shaft portion 92. The developer discharge portion 96, as shown in FIG. 14, is structured such that the outer peripheral plate 99 can close the discharge port 91 to thereby prevent the leakage of the developer 61.

The upstream side end portion 95*a* of the delivery vane portion 95 along the delivery direction thereof, as shown in FIG. 15B, is connected to the above-mentioned stirring portion 94. Thus, the developer 61, which has been stirred up and resolved along the peripheral direction of the rotation shaft portion 92 by the stirring portion 94, can be introduced smoothly into the upstream side end portion of the delivery vane portion 95 along the delivery direction thereof and can be delivered by the delivery vane portion 95.

Also, the downstream side end portion 95*b* of the delivery vane portion 95 along the delivery direction thereof, as shown in FIG. 15B, is connected to the upstream side end portion of the above-mentioned developer discharge portion 96 along the peripheral direction of the opening 96*a*, whereby the developer 61 delivered along the axial direction of the rotation shaft portion 92 by the deliver vane portion 95 can be smoothly introduced into the opening 96*a* of the developer discharge portion 96.

The developer discharge portion 96 is structured in the following manner. That is, the developer discharge portion 96 can scoop up a new developer 61, which has been delivered along the axial direction of the rotation shaft portion 92 by the delivery vane portion 95 of the delivery auger 79, into the developer discharge portion 96 which is formed to have a substantially bucket-like shape; and, from the developer discharge portion 96 which has been moved upwardly due to the rotation of the rotation shaft portion 92, the new developer 61 can be supplied and dropped into the downward-situated discharge port 90 in a pressurized state.

Figure 18:
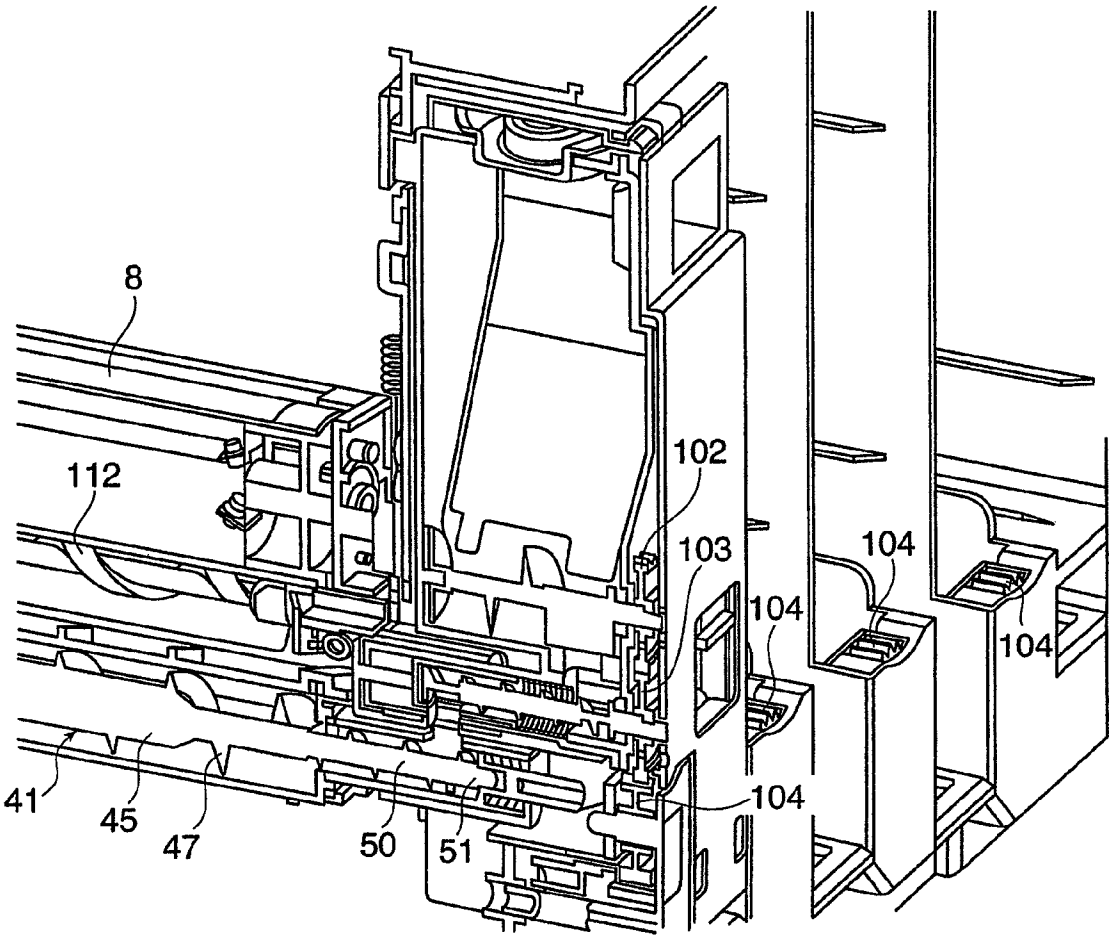
FIG. 18 is a perspective section view of the main portions of an image forming apparatus.
Figure 19:
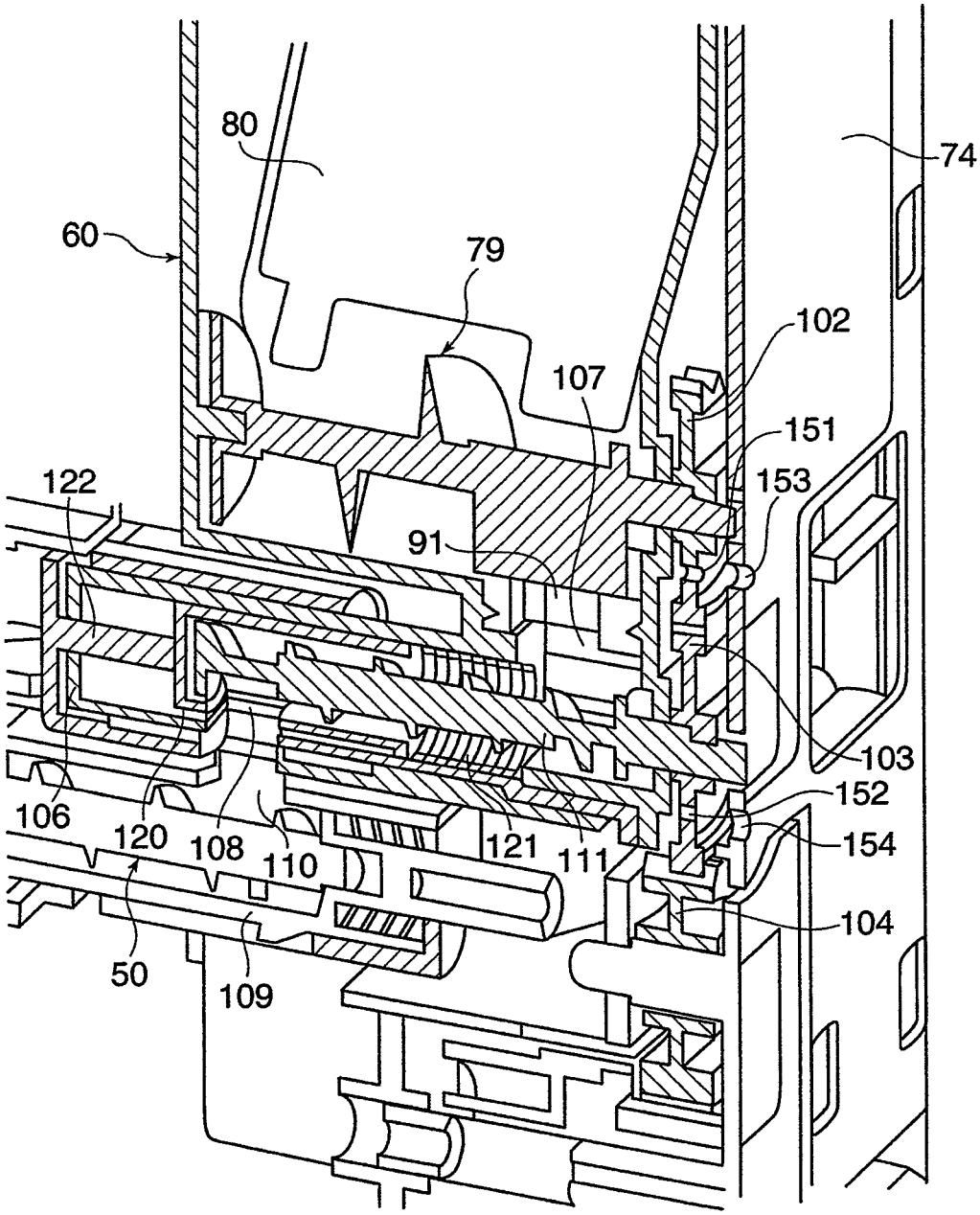
FIG. 19 is a perspective section view of the main portions of an image forming apparatus.

Also, the leading end portion 101 of the rotation shaft portion 92, as shown in FIG. 14, is formed to have a substantially D-shaped section and, onto the leading end portion 101, as shown in FIGS. 18 and 19, there can be mounted a first drive gear 102 which is used to drive and rotate the delivery auger 79. The first drive gear 102 is meshingly engaged with a second drive gear 103, while the second drive gear 103 is meshingly engaged with a gear 104 which is mounted on the printer main body 1.

And, in a state where the toner cartridges 60Y, 60M, 60C and 60K are mounted on the printer main body 1 as shown in FIG. 5, as shown in FIGS. 18 and 19, from the main body side gear 104 which can be driven and rotated at a predetermined timing, there is transmitted its rotational drive power to the first drive gear 102 through the second drive gear 103, whereby the delivery auger 79 can be driven and rotated at a predetermined timing. The delivery auger 79, for example, can be driven and rotated intermittently by the main body side gear 104, whereby the discharge port 90 of the discharge port forming member 91 can be opened and closed intermittently by the developer discharge portion 96 of the deliver auger 79. The timing for opening and closing the discharge port 90 of the discharge port forming member 91 can be set arbitrarily. For example, in the case that one rotation of the delivery auger 79 is set for 1, the discharge port 90 can be opened and closed in such a manner that the opening time thereof occupies a ratio of about 0.3~0.5.

Figure 20:
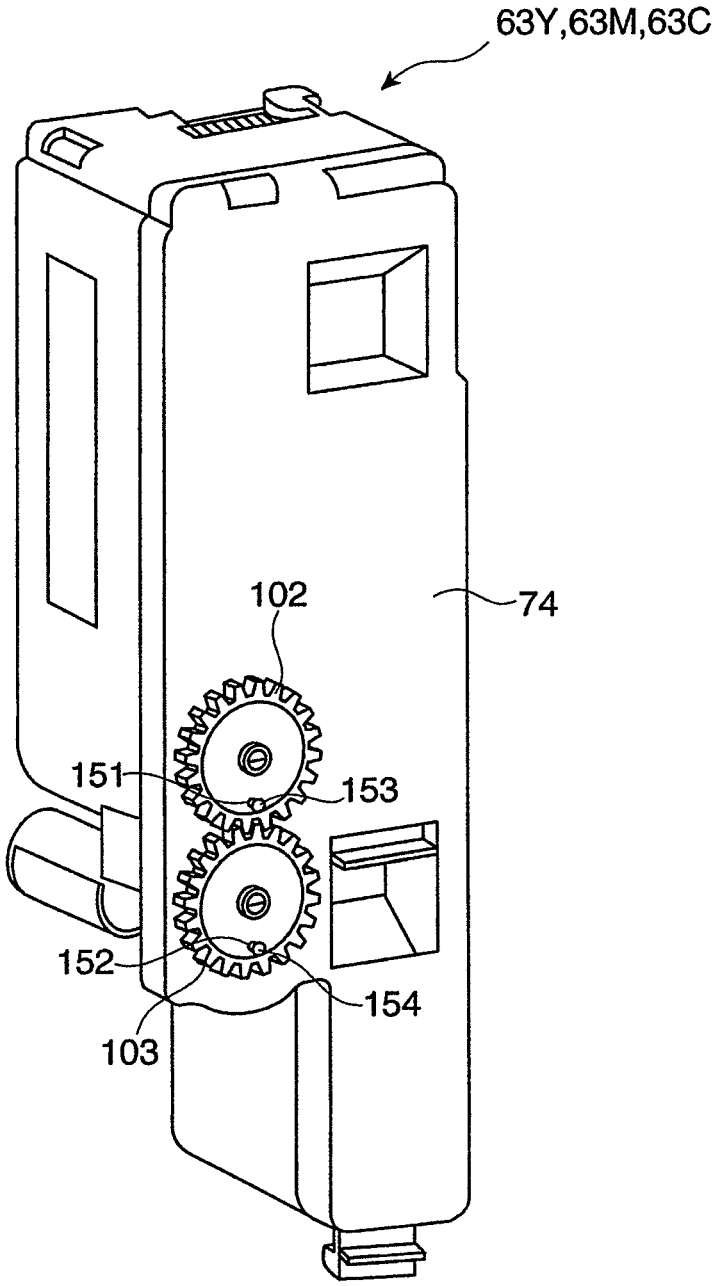
FIG. 20 is a perspective structure view of a toner cartridge.

Also, in the first and second drive gears 102 and 103, as shown in FIGS. 19 and 20, in order to be able to visually confirm from outside whether the developer discharge portion 96 of the delivery auger 79 is closing the discharge port 90 or not, there are formed positioning holes 151 and 152 which, in a state where the developer discharge portion 96 of the delivery auger 79 is closing the discharge port 90, are respectively allowed to correspond to position confirming holes 153 and 154 formed in the cover member 74.

And, the toner cartridges 60Y, 60M, 60C and 60K, as shown in FIGS. 18 and 19, respectively include integrally therewith a developer supply unit 105 which does not supply a new developer 61 supplied from the toner cartridges 60Y, 60M, 60C and 60K immediately to the developing device 10 from the discharge port 90 but supplies the developer 61 supplied from the new developer storage chamber 81 to the developing device 10. This developer supply unit 105, as shown in FIG. 12, includes a cylindrical-shaped developer supply member 106 which is formed downwardly of the new developer storage chamber 81 of the toner cartridges 60Y, 60M, 60C and 60K integrally therewith.

The developer supply member 106, as shown in FIG. 19, is disposed parallel to the delivery auger 79 and, in one end portion of the developer supply member 106, there is formed an introduction hole 107 which is used to introduce the developer supplied from the discharge port 91. The introduction hole 107 is structured such that it can be closed simultaneously when the discharge port 91 is closed by the arc-shaped outer peripheral plate 99 of the discharge port 96 formed substantially in a bucket shape in the delivery auger 79.

Also, in the other end portion of the developer supply member 106, as shown in FIG. 19, there is formed a supply port 108 which opens downward and is used to supply the developer. The supply port 108 is opened up at a position which corresponds to the position of a receive port 110 which is opened up in the upper end portion of a developer supply cylindrical portion 109 for covering the outer periphery of the developer supply auger 50 of the developing device 10.

Further, within the developer supply member 106, as shown in FIG. 19, there is rotatably disposed a supply auger 111 which is used to supply the developer. The supply auger 111, as shown in FIG. 21, is formed of synthetic resin or the like in an integral body and includes: a rotation shaft 112 so formed in the central portion thereof as to extend along the delivery direction; a disk-shaped support portion 113 disposed in the downstream side end portion of the outer periphery of the rotation shaft 112 in the delivery direction thereof; a delivery vane portion 114 provided on the outer periphery of the rotation shaft 112 in such a manner that it extends spirally; and, a disk-shaped seal portion 115 formed on the upstream side of the rotation shaft 112 along the delivery direction thereof.

Figure 21:
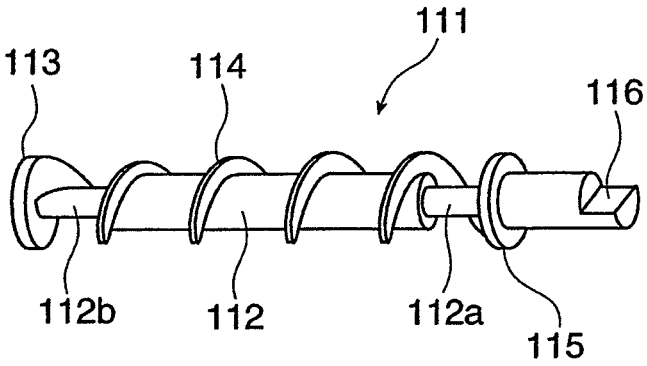
FIG. 21 is a perspective structure view of a delivery auger.
Figure 22:
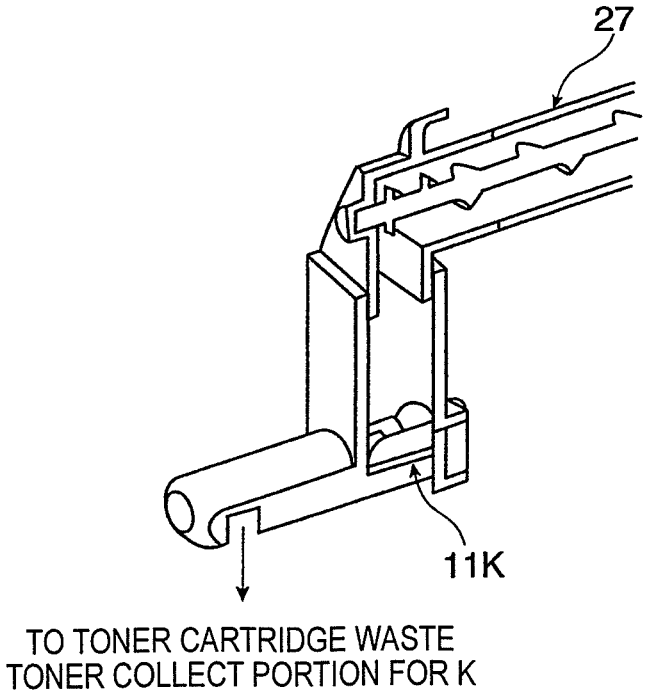
FIG. 22 is a perspective structure view of a waste toner delivery portion for black.

Also, the base end portion 116 of the rotation shaft 112, as shown in FIG. 21, is formed to have a substantially D-shaped section and, on the base end portion 116, as shown in FIG. 19, there is mounted the second drive gear 103 which is used to drive and rotate the supply auger 111. With the second drive gear 103, there is meshingly engaged the main body side gear 104 which, as described above, is mounted on the printer main body 1.

Here, such portions 112*a* and 112*b* of the rotation shaft 112 of the supply auger 111 as correspond to the introduction port 107 and supply port 108 are respectively set smaller in diameter than the other portions of the rotation shaft 112, whereby the reception of the developer 61 from the introduction port 107 and the supply of the developer from the supply port 108 can be carried out positively.

Also, onto the leading end portion of the interior of the developer supply member 106, as shown in FIG. 19, there is slidably provided a shutter member 120 which is so energized by a spring 121 as to be able to close the supply port 108. The shutter member 120 is structured such that, when the toner cartridges 60Y, 60M, 60C and 60K are mounted onto the printer main body 1, as shown in FIG. 19, it is pressed by a fine shaft-shaped operating projection 122 so provided as to project into the interior portions of the toner cartridges 60Y, 60M, 60C and 60K of the printer main body 1, whereby it is moved to a position where it opens the supply port 108.

Also, the toner cartridges 60Y, 60M, 60C and 60K are structured such that they can collect waste toners discharged from the cleaning devices 11Y, 11M, 11C and 11K and belt cleaning device 27 of the printer main body 1.

That is, in the toner cartridges 60Y, 60M, 60C and 60K, as shown in FIG. 13, on the back surface side of the waste developer storage chamber 82, there are opened up introduction ports 130 which are used to introduce waste toners discharged from the cleaning devices 11Y, 11M, 11C and 11K and belt cleaning device 27 of the printer main body 1. On the outer periphery of each of the introduction port 130, there is provided a seal member 131 which is made of a sponge or the like and is used to prevent the leakage of the toners. Also, the introduction port 130 is normally closed by a second shutter 132 which is energized by a spring 142 shown in FIG. 12.

And, the waste toner introduction ports 130 of the toner cartridges 60Y, 60M, 60C and 60K can be opened because the second shutter members 132 are pressed inwardly by the developer collect portions 66Y, 66M, 66C and 66K of the printer main body 1 when the toner cartridges 60Y, 60M, 60C and 60K are mounted onto the printer main body 1.

Here, the developer collect portion 66K for black of the printer main body 1, as described above, is structured to collect the waste toners from the cleaning device 11K for black as well as the waste toners from the belt cleaning device 27 of the intermediate transfer belt 12. In this case, since the belt cleaning device 27 of the intermediate transfer belt 12 is situated just above the cleaning device 11K for black as shown in FIG. 2, and also since the developer collect portion 66K for black is structured such that it connects together the end portion of the belt cleaning device 27 of the intermediate transfer belt 12 and the end portion of the cleaning device 11K for black, the developer collect portion 66K joins together the waste toners collected by itself and the waste toners collected by the belt cleaning device 27 of the intermediate transfer belt 12 and allows the discharge auger of the cleaning device 11K for black to discharge the thus joined waste toners to the introduction port 132 of the toner cartridge 60K for black.

In the above structure, according to a color printer to which a developer storage container according to the present embodiment is applied, the developer stored within the developer storage container can be delivered stably to the developer discharge port in the following manner.

That is, in the color printer according to the present embodiment, as shown in FIG. 2, the toner images of the respective colors are formed sequentially by the image forming units 6Y, 6M, 6C and 6K respectively for yellow (Y), magenta (M), cyan (C) and black (K); the toner images of the respective colors formed on the sensitive drums 8 of the image forming units 6Y, 6M, 6C and 6K are primarily transferred onto the intermediate transfer belt 12 sequentially and multiply; after then, the toner images are secondarily transferred at secondary transfer positions from the surface of the intermediate transfer belt 12 onto the recording paper 16 collectively; the toner images are fixed onto the recording paper 16; and, as shown in FIG. 4, the thus fixed images are discharged onto the discharge tray 22 which is provided in the upper portion of the printer main body 1.

In the above color printer, as shown in FIG. 2, when the toner images of the respective colors are formed by the image forming units 6Y, 6M, 6C and 6K respectively for yellow (Y), magenta (M), cyan (C) and black (K), since the toners stored within the developing devices 10 of the image forming units 6Y, 6M, 6C and 6K are consumed gradually and thus the toner density within the developing devices is thereby lowered, to the developing devices 10 of the image forming units 6Y, 6M, 6C and 6K, as shown in FIG. 5, there are supplied from the toner cartridges 60Y, 60M, 60C and 60K the new developers 61 containing at least toners of the corresponding colors.

Also, when the new developers 61 stored within the toner cartridges 60Y, 60M, 60C and 60K are supplied therefrom and thus the new developer storage chambers are emptied or are almost emptied, as shown in FIGS. 4 and 5, the side cover 29 of the printer main body 1 is opened, the emptied or almost emptied toner cartridges 60Y, 60M, 60C and 60K are removed from the printer main body 1, and new toner cartridges 60Y, 60M, 60C and 60K are mounted into the printer main body 1.

When the toner cartridges 60Y, 60M, 60C and 60K are mounted into the printer main body 1 as shown in FIG. 5, the drive gear and intermediate gear for driving and rotating the delivery auger and supply auger are meshingly engaged with the main body side gears provided on the printer main body 1, and also the supply port of the developer supply member 106 is opened.

And, in the toner cartridges 60Y, 60M, 60C and 60K, as shown in FIGS. 18 and 19, by driving and rotating the gear 104 of the printer main body 1 at a predetermined timing, the rotation drive forces of the main body side gears 104 are transmitted to the first and second drive gears 102 and 103, whereby the delivery auger 79 and supply auger 111 can be driven and rotated.

Figure 16:
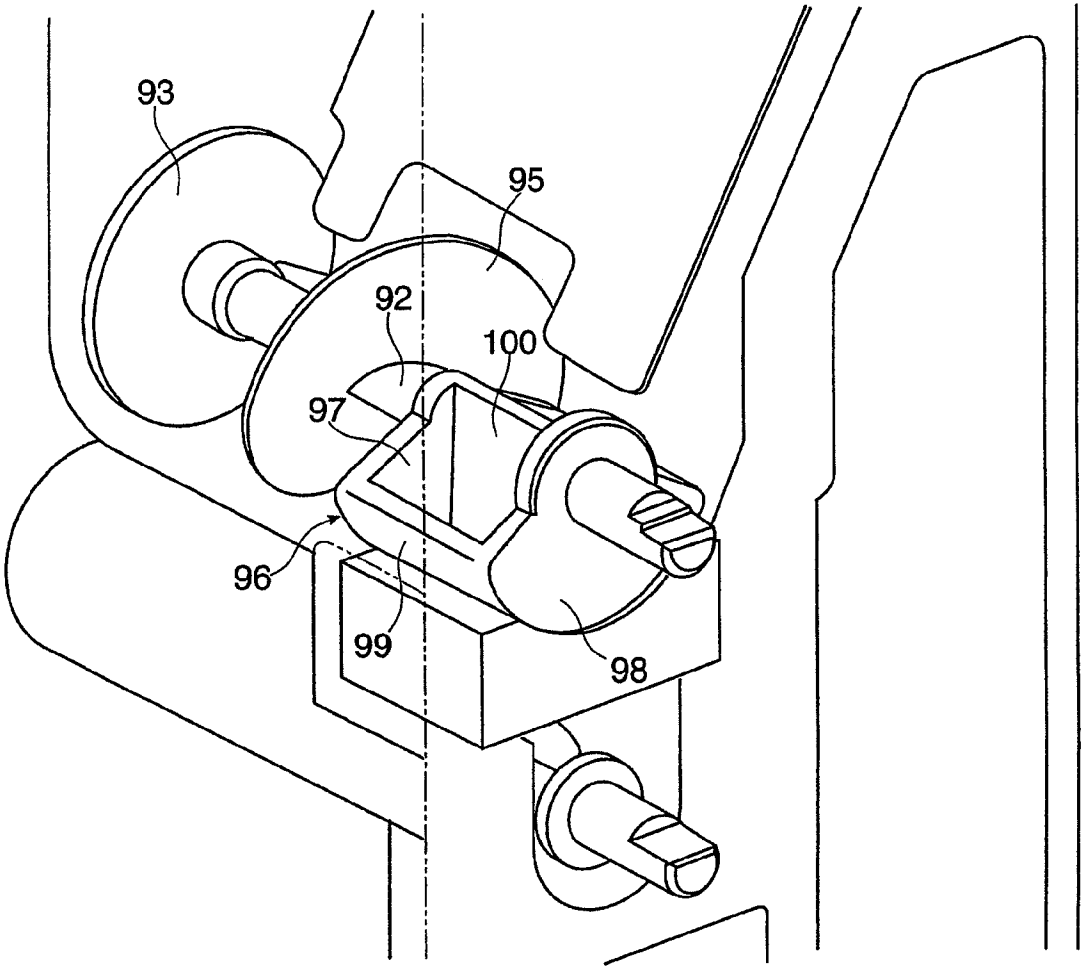
FIG. 16 is a perspective structure view of the main portions of a toner cartridge.
Figure 17:
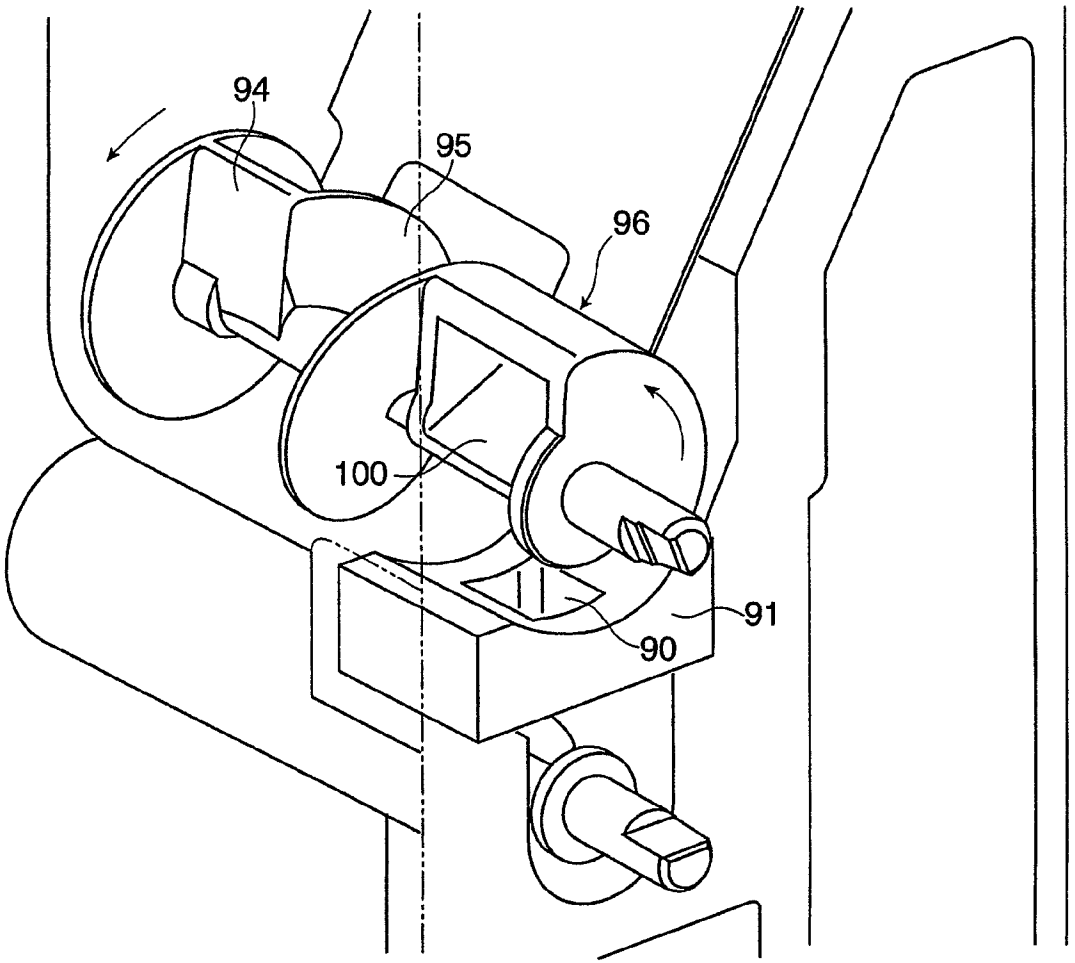
FIG. 17 is a perspective structure view of the main portions of a toner cartridge.

When the delivery auger 79 is driven rotationally, the new developer 61 situated on the bottom portion of the new developer storage chamber 81, as shown in FIGS. 1, 16 and 17, is scraped off and collapsed along the peripheral direction of the chamber 81 by the flat plate portion 94 (shown in FIG. 15B) provided on the upstream side end portion of the delivery auger 79 along the axial direction thereof; and, the new developer 61 scraped and collapsed by the flat plate portion 94 is delivered downstream by the delivery vane 95 provided on the middle portion of the delivery auger 79 along the axial direction thereof.

And, the new developer 61, which has been delivered downstream in the axial direction by the delivery vane 95 of the delivery auger 79, is scooped up and stored by the bucket-shaped discharge portion 96 of the delivery auger 79 and, as shown in FIG. 17, is discharged from the discharge port 90 formed in the downstream side end portion of the delivery auger 79 along the axial direction thereof.

In this manner, in a state where the delivery auger 79 stores the developer 61 to be delivered by the delivery vane portion 95 in the downstream side end portion in the delivery direction thereof, the delivery auger 79 is delivered along the peripheral direction of the rotation shaft portion 92 by the developer discharge portion 96 which is rotating along the peripheral direction of the rotation shaft portion 92, whereby the developer can be supplied stably from the developer discharge port 90 which is formed downwardly of the developer discharge portion 96.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder delivery member, comprising:

a rotation shaft portion that is disposed rotatably within a powder storage container with powder stored therein;

a delivery portion that delivers the powder along the axial direction of the rotation shaft portion; and a powder discharge portion:

(i) disposed at an end portion of the delivery portion on a downstream side in a delivery direction of the delivery portion and configured to rotate together with the delivery portion, (ii) disposed at a position corresponding to a powder discharge port of the powder storage container, (iii) configured to store therein the powder delivered thereto from the delivery portion, and (iv) configured to deliver the stored powder to the powder discharge port in response to being rotated with the rotation shaft portion with the powder stored therein, wherein the powder discharge portion comprises a pair of fan-shaped side plates and a curved outer plate, and wherein the curved outer plate is disposed between the pair of fan-shaped side plates at a distance farthest away from a center of the rotation shaft portion in a radial direction.

2. The powder delivery member according to claim 1, wherein:

an downstream side end portion of the delivery portion along the delivery direction is connected to an upstream side end portion of an opening of the powder discharge portion along the rotation direction thereof.

3. The powder delivery member according to claim 1, wherein:

the powder discharge portion is capable of closing the powder discharge port of the powder storage container.

4. The powder delivery member according to claim 1, further comprising: a confirming unit that allows to confirm from outside the position of the powder discharge portion along the peripheral direction thereof.

5. The powder delivery member according to claim 1, wherein: the powder discharge port of the powder storage container is formed of an elastic member which can be elastically deformed when it is pressed by the powder discharge portion.

6. The powder delivery member according to claim 1, further comprising:

a flat-plate-shaped stifling portion that extends along a radial direction of the rotation shaft portion in an upstream side end portion of the delivery portion along the delivery direction thereof, and that stirs the powder stored within the powder storage container.

7. A powder storage container, comprising:

a powder storage portion that stores therein the powder; and a powder delivery member comprising:

a rotation shaft portion that is disposed rotatably within a powder storage container with powder stored therein;

a delivery portion that delivers the powder along the axial direction of the rotation shaft portion; and a powder discharge portion:

(i) disposed at an end portion of the delivery portion on a downstream side in a delivery direction of the delivery portion and configured to rotate together with the delivery portion, (ii) disposed at a position corresponding to a powder discharge port of the powder storage container, (iii) configured to store therein the powder delivered thereto from the delivery portion, and (iv) configured to deliver the stored powder to the powder discharge port in response to being rotated with the rotation shaft portion with the powder stored therein wherein the powder delivery member is disposed rotatably within the powder storage portion and is configured to deliver the powder stored within the powder storage portion to the discharge port while stifling the powder, wherein the powder discharge portion comprises a pair of fan-shaped side plates and a curved outer plate, and wherein the curved outer plate is disposed between the pair of fan-shaped side plates at a distance farthest away from a center of the rotation shaft portion in a radial direction.

8. An image forming apparatus, comprising:

an image holding member that forms thereon an electrostatic latent image corresponding to image information;

a developing device main body that develops the electrostatic latent image formed on the image holding member, an developer holding member holding the powder on the surface thereof being rotatably disposed on the developing device main body; and a powder storage container comprising:

a powder storage portion that stores therein the powder; and a powder delivery member comprising:

a rotation shaft portion that is disposed rotatably within a powder storage container with powder stored therein;

a delivery portion that delivers the powder along the axial direction of the rotation shaft portion; and a powder discharge portion:

(i) disposed at an end portion of the delivery portion on a downstream side in a delivery direction of the delivery portion and configured to rotate together with the delivery portion, (ii) disposed at a position corresponding to a powder discharge port of the powder storage container, (iii) configured to store therein the powder delivered thereto from the delivery portion, and (iv) configured to deliver the stored powder to the powder discharge port in response to being rotated with the rotation shaft portion with the powder stored therein wherein the powder delivery member is disposed rotatably within the powder storage portion and is configured to deliver the powder stored within the powder storage portion to the discharge port while stifling the powder, wherein the powder storage container is configured to store therein the powder to be supplied to the powder device main body, wherein the powder discharge portion comprises a pair of fan-shaped side plates and a curved outer plate, and wherein the curved outer plate is disposed between the pair of fan-shaped side plates at a distance farthest away from a center of the rotation shaft portion in a radial direction.

9. The powder storage container according to claim 7, wherein:

an downstream side end portion of the delivery portion along the delivery direction is connected to an upstream side end portion of an opening of the powder discharge portion along the rotation direction thereof.

10. The powder storage container according to claim 7, wherein:

the powder discharge portion is capable of closing the powder discharge port of the powder storage container.

11. The powder storage container according to claim 7, further comprising: a confirming unit that allows to confirm from outside the position of the powder discharge portion along the peripheral direction thereof.

12. The powder storage container according to claim 7, wherein: the powder discharge port of the powder storage container is formed of an elastic member which can be elastically deformed when it is pressed by the powder discharge portion.

13. The powder storage container according to claim 7, further comprising:

a flat-plate-shaped stifling portion that extends along a radial direction of the rotation shaft portion in an upstream side end portion of the delivery portion along the delivery direction thereof, and that stirs the powder stored within the powder storage container.

14. The image forming apparatus according to claim 8, wherein:

an downstream side end portion of the delivery portion along the delivery direction is connected to an upstream side end portion of an opening of the powder discharge portion along the rotation direction thereof.

15. The image forming apparatus according to claim 8, wherein:

the powder discharge portion is capable of closing the powder discharge port of the powder storage container.

16. The image forming apparatus according to claim 8, further comprising: a confirming unit that allows to confirm from outside the position of the powder discharge portion along the peripheral direction thereof.

17. The image forming apparatus according to claim 8, wherein: the powder discharge port of the powder storage container is formed of an elastic member which can be elastically deformed when it is pressed by the powder discharge portion.

18. The image forming apparatus according to claim 8, further comprising:

a flat-plate-shaped stifling portion that extends along a radial direction of the rotation shaft portion in an upstream side end portion of the delivery portion along the delivery direction thereof, and that stirs the powder stored within the powder storage container.

19. The powder delivery member according to claim 1, wherein the powder discharge portion is configured to scoop up the powder according to the rotation of the powder discharge portion.

20. The powder storage container according to claim 7, wherein the powder discharge portion is configured to scoop up the powder according to the rotation of the powder discharge portion.

21. The image forming apparatus according to claim 8, wherein the powder discharge portion is configured to scoop up the powder according to the rotation of the powder discharge portion.

* * * * *